US008063833B2

(12) United States Patent
Sievenpiper

(10) Patent No.: US 8,063,833 B2
(45) Date of Patent: Nov. 22, 2011

(54) METHOD OF ACHIEVING AN OPAQUE OR ABSORPTION STATE IN A TUNABLE FREQUENCY SELECTIVE SURFACE

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 12/563,375

(22) Filed: Sep. 21, 2009

(65) Prior Publication Data

US 2010/0073261 A1 Mar. 25, 2010

Related U.S. Application Data

(62) Division of application No. 11/637,371, filed on Dec. 11, 2006, now Pat. No. 7,612,718, which is a division of application No. 10/903,190, filed on Jul. 30, 2004, now Pat. No. 7,173,565.

(51) Int. Cl.
*H01Q 1/38* (2006.01)

(52) U.S. Cl. ..... 343/700 MS; 343/853; 343/893

(58) Field of Classification Search ..... None
See application file for complete search history.

(56) References Cited

U.S. PATENT DOCUMENTS

| | | | | |
|---|---|---|---|---|
| 5,208,603 | A | 5/1993 | Yee | 343/909 |
| 5,278,562 | A | 1/1994 | Martin et al. | 342/13 |
| 5,600,325 | A | 2/1997 | Whelan et al. | 342/13 |
| 5,619,365 | A | 4/1997 | Rhoads et al. | 359/248 |
| 5,619,366 | A | 4/1997 | Rhoads et al. | 359/248 |
| 6,028,692 | A | 2/2000 | Rhoads et al. | 359/245 |
| 6,483,480 | B1 | 11/2002 | Sievenpiper et al. | 343/909 |
| 6,538,621 | B1 | 3/2003 | Sievenpiper et al. | 343/909 |
| 6,552,696 | B1 | 4/2003 | Sievenpiper et al. | 343/909 |
| 6,806,843 | B2 | 10/2004 | Killen et al. | 343/795 |
| 6,897,831 | B2 | 5/2005 | McKinzie et al. | 343/909 |
| 6,917,343 | B2 | 7/2005 | Sanchez et al. | 343/795 |
| 7,071,888 | B2 | 7/2006 | Sievenpiper | 343/745 |
| 2002/0057222 | A1 | 5/2002 | McKinzie et al. | 343/700 MS |
| 2002/0167456 | A1 | 11/2002 | McKinzie | 343/909 |
| 2002/0167457 | A1 | 11/2002 | McKinzie et al. | 343/909 |
| 2004/0263408 | A1 | 12/2004 | Sievenpiper et al. | 343/757 |

OTHER PUBLICATIONS

Bushbeck, M.D., et al., "A Tuneable, Switchable Dielectric Grating," IEEE Microwave and Guided Wave Letters, vol. 3, No. 9, pp. 296-298 (Sep. 1993).

Chambers, B., et al., "Tunable Radar Absorbers Using Frequency Selective Surfaces," 11th International Conference on Antennas and Propagation, Conference Publication No. 480, pp. 593-598 (Apr. 17-20, 2001).

Chang, T.K., et al., "Frequency Selective Surfaces on Biased Ferrite Substrates," Electronics Letters, vol. 30, No. 15, pp. 1193-1194 (Jul. 21, 1994).

Gianvittorio, J.P., et al., "Reconfigurable MEMS-enabled Frequency Selective Surfaces," Electronics Letters, vol. 38, No. 25, pp. 1627-1628 (Dec. 5, 2002).

Lima, A.C. De C., et al., "Tunable Frequency Selective Surfaces Using Liquid Substrates," Electronics Letters, vol. 30, No. 4, pp. 281-282 (Feb. 17, 1994).

Oak, A.C., et al., "A Varactor Tuned 16-Element MESFET Grid Oscillator," Antennas and Propagation Society International Symposium, pp. 1296-1299 (1995).

*Primary Examiner* — Trinh Dinh
(74) *Attorney, Agent, or Firm* — Ladas & Parry

(57) ABSTRACT

Methods for tuning at least a region of a tunable frequency selective surface. The methods disclosed how to achieve an opaque or absorptive state in at least a region of tunable frequency selective surface.

12 Claims, 42 Drawing Sheets

Figure 5A:
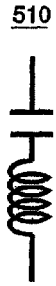

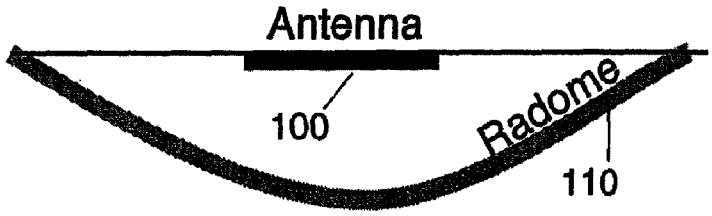
Figure 1
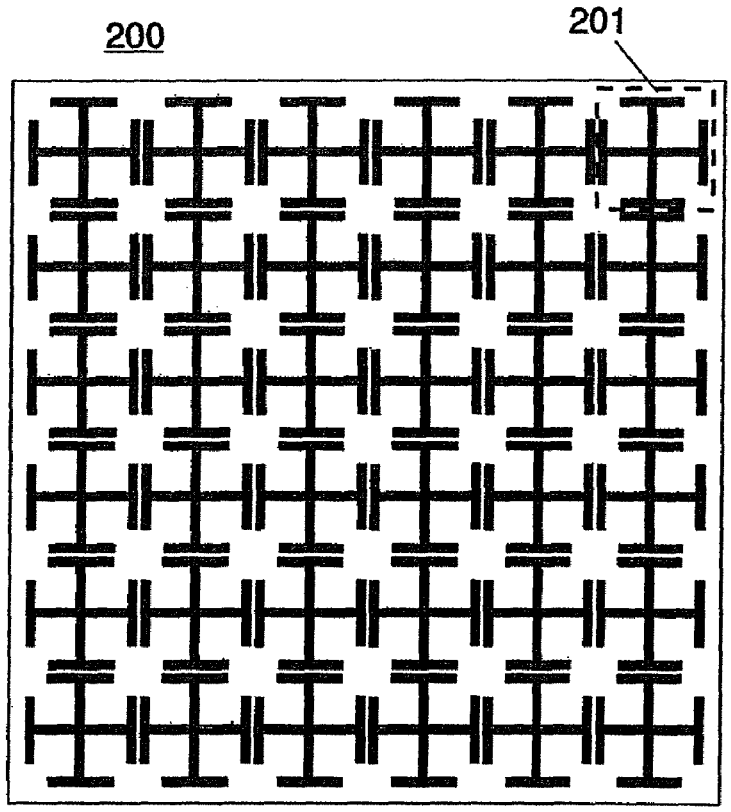
PRIOR ART Figure 2a

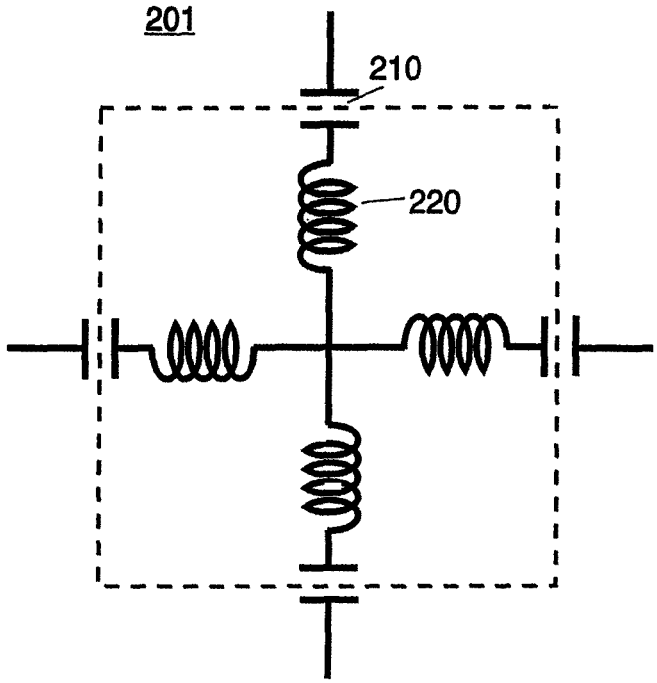
PRIOR ART Figure 2b
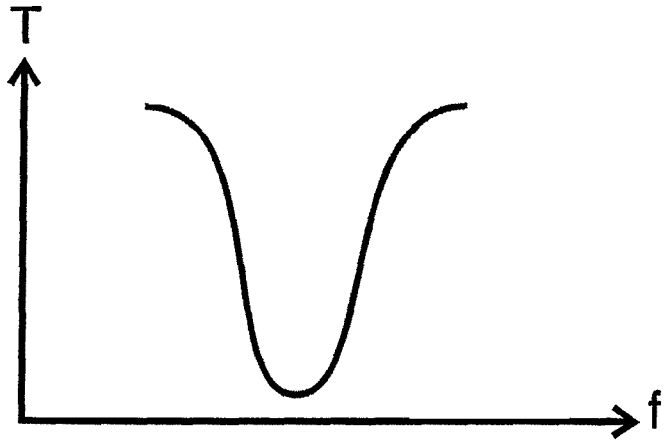
PRIOR ART Figure 2c

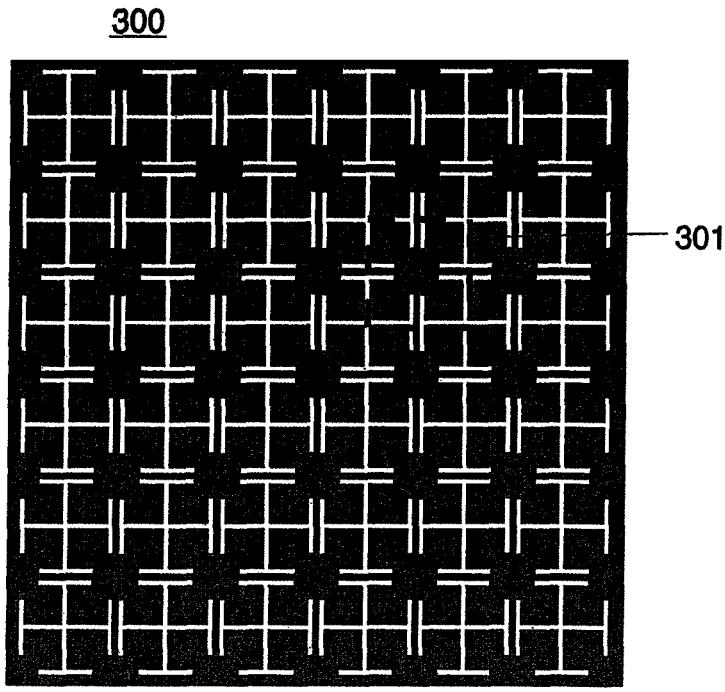
PRIOR ART Figure 3a
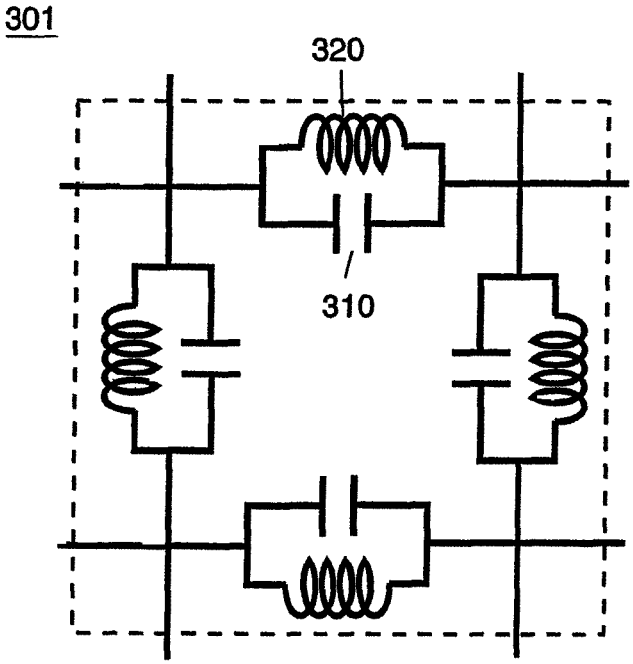
PRIOR ART Figure 3b

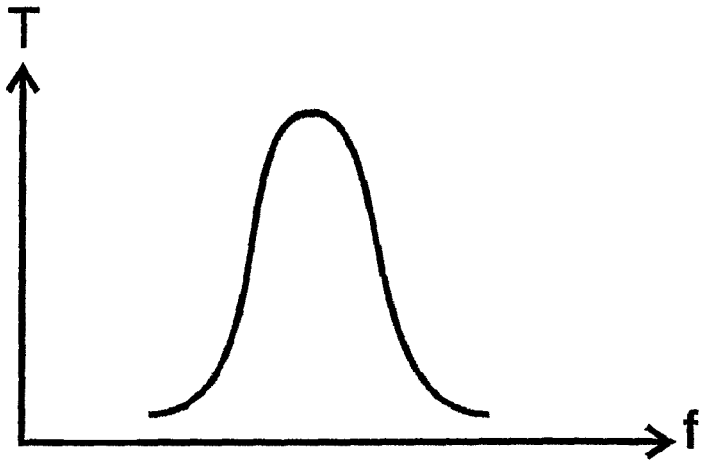
PRIOR ART Figure 3c
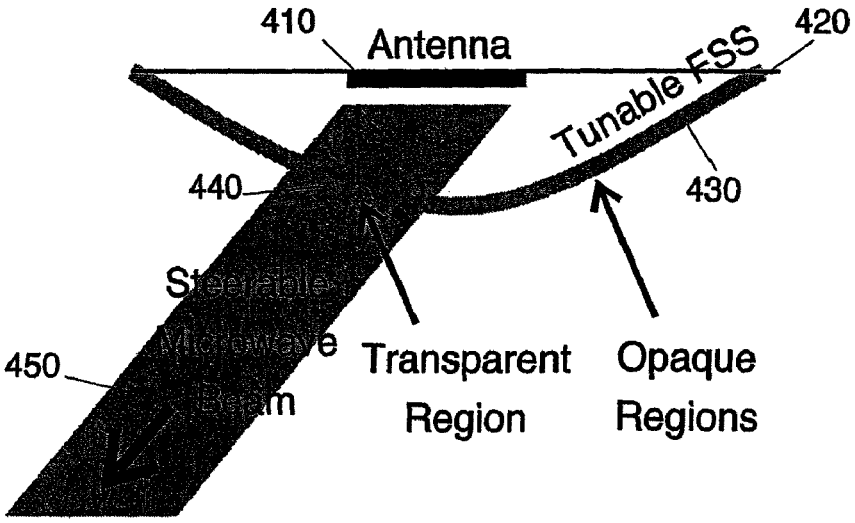
Figure 4

METHOD OF ACHIEVING AN OPAQUE OR ABSORPTION STATE IN A TUNABLE FREQUENCY SELECTIVE SURFACE

CROSS-REFERENCE TO RELATED APPLICATION

This application is a division of U.S. patent application Ser. No. 11/637,371, filed on Dec. 11, 2006, which is a division of U.S. patent application Ser. No. 10/903,190, filed on Jul. 30, 2004, issued as U.S. Pat. No. 7,173,565 on Feb. 6, 2007, the disclosure of which is incorporated herein by reference in its entirety.

FIELD OF THE INVENTION

This technology relates to a frequency selective surface that can be tuned to an on-state, off-state and/or can transmit/reflect electromagnetic energy in any frequency band.

BACKGROUND AND PRIOR ART

Antennas 100 may be hidden behind a radome 110, see FIG. 1, particularly if they are being used in an application where they could be exposed to the environment. The radome protects the antenna from both the natural environment such as rain and snow, and the man-made environment such as jamming signals. Often, the radome is made so that it transmits electromagnetic energy within a narrow band centered around the operating frequency of the antenna, so as to deflect or reflect jamming signals at other frequencies. This is done using a frequency selective surface (FSS), having a grid or lattice of metal patterns or holes in a metal sheet. The design and construction of FSSs is well known to those skilled in the art of radome design and electromagnetic material design.

Two surfaces are commonly used in FSS design, the "Jerusalem cross" structure 200, shown in FIG. 2*a*, and its "Inverse structure" 300, shown in FIG. 3*a*. A unit cell equivalent circuit 201 of the Jerusalem cross 200, FSS can be viewed as a lattice of capacitors 210 and inductors 220 in series, shown in FIG. 2*b*. The capacitors 210 and inductors 220 are oriented in two orthogonal directions so that the surface can affect both polarizations. Near the LC resonance frequency, the series LC circuit has low impedance, and shorts out the incoming electromagnetic wave, thereby deflecting it off the surface. At other frequencies, the LC circuit is primarily transmitting, although it does provide a phase shift for frequencies near the stop band, shown in FIG. 2*c*.

The Inverse structure 300, shown in FIG. 3*a*, has opposite characteristics. A unit cell equivalent circuit 301 of the Inverse structure 300, FSS can be viewed as a lattice of capacitors 310 and inductors 320 in parallel, shown in FIG. 3*b*. It is transmissive near LC resonance frequency and reflective at other frequencies, shown in FIG. 3*c*.

The radome typically transmits RF energy through the radome only at the operating frequency of the antenna, and reflects or deflects at other frequencies. In some applications, it may be desirable to tune the radome, particularly when a tunable antenna is used inside the radome. It may also be desirable to set the radome to an entirely opaque (off) state, so that it is deflective or reflective over a broad range of frequencies. It may also be desirable to program the radome so that different regions have different properties, either transmitting within a frequency band, or opaque as desired. To achieve these requirements the FSS needs to be tunable.

Throughout the years, different techniques have been implemented to achieve the tuning of the FSS. The tuning has been achieved by: varying the resistance, see Chambers, B., Ford, K. L., "Tunable radar absorbers using frequency selective surfaces", Antennas and Propagation, 2001. Eleventh International Conference on (IEEE Conf. Publ. No. 480), vol. 2, pp. 593-597, 2001; pumping liquids that act as dielectric loading, see Lima, A. C. deC., Parker, E. A., Langley, R. J., "Tunable frequency selective surface using liquid substrates", Electronics Letters, vol. 30, issue 4, pp. 281-282, 1994; rotating metal elements, see Gianvittorio, J. P., Zendejas, J., Rahmat-Sami, Y., Judy, J., "Reconfigurable MEMS-enabled frequency selective surfaces", Electronics Letters, vol. 38, issue 25, pp. 1627-1628, 2002; using a ferrite substrate, see Chang, T. K., Langley, R. J., Parker, E. A., "Frequency selective surfaces on biased ferrite substrates", Electronics Letters, vol. 30, issue 15, pp. 1193-1194, 1994; pressurizing a fluid, see Bushbeck, M. D., Chan, C. H., "A tunable, switchable dielectric grating", IEEE Microwave and Guided Wave Letters, vol. 3, issue 9, pp. 296-298, 1993; using a varactor tuned grid array that is a kind of quasi-optic oscillator, see Oak, A. C., Weikle, R. M. Jr., "A varactor tuned 16-element MESFET grid oscilator", Antennas and Propagation Society International Symposium, 1995; using an electro-optic layer, see Rhoads' patent (U.S. Pat. No. 6,028,692); using transistors, see Rhoads' patent (U.S. Pat. No. 5,619,366); using ferroelectrics between an absorptive state and a transmissive state, see Whelan's patent (U.S. Pat. No. 5,600,325).

Although the above-mentioned methods are used to tune the FSS, these methods are not ideal for use with a tunable antenna. Many of the above methods are not practical for rapid tuning because they use moving metal parts, or pumping dielectric liquids. Some of them include switching between discrete states using transistors, which is less useful than a continuous tunable surface. Others include only on and off states, and cannot be tuned in frequency. Others require bulk ferrite, ferroelectric, or electrooptic materials, which can be lossy and expensive. None of the prior art achieves the capabilities of the presently disclosed Tunable FSS (TFSS) technology, even though a need exists for those capabilities.

The present TFFS is able to pass electromagnetic energy in a particular frequency band through the radome, and deflect or reflect electromagnetic energy in other frequency bands, as shown, for example, in FIG. 4. It can also be tuned to an off state where it is deflective or reflective, or an on state where it is absorptive over a broad range of frequencies. Also some regions of the surface can be tuned to different frequencies while other regions of the surface can be set to an opaque state, shown in FIG. 4.

BRIEF DESCRIPTION OF THE FIGURES AND THE DRAWINGS

Figure 5B:
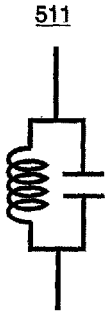
Figure 5C:
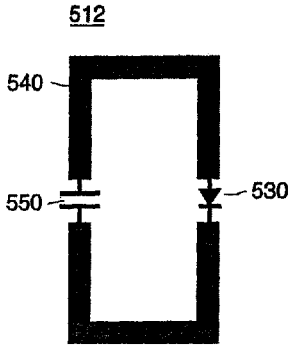
Figure 5D:
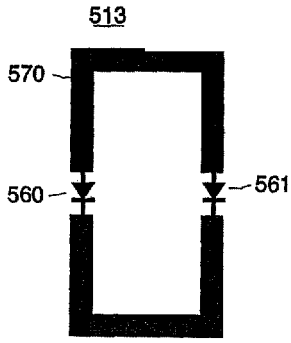
Figure 6A:
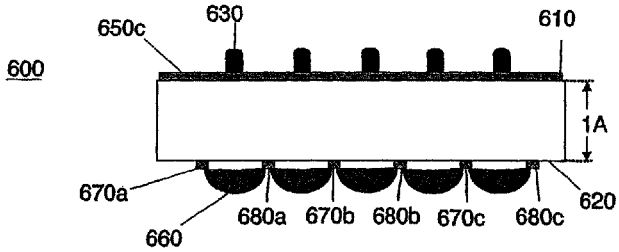
Figure 6B:
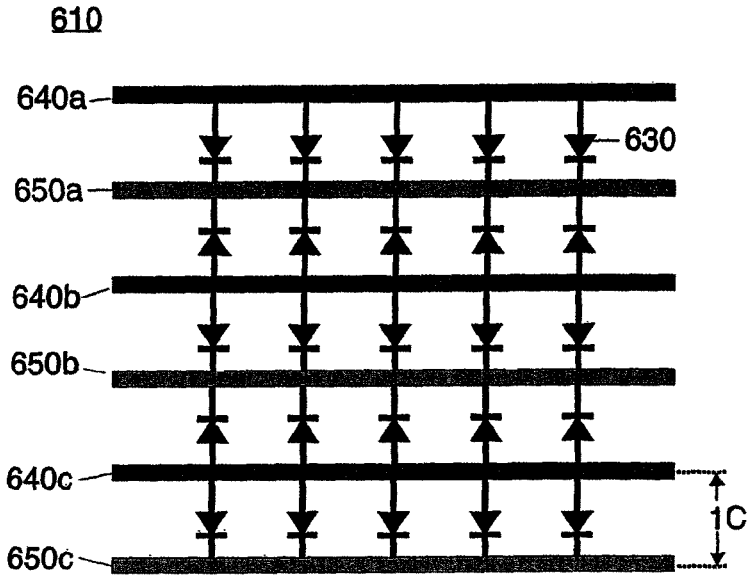
Figure 6C:
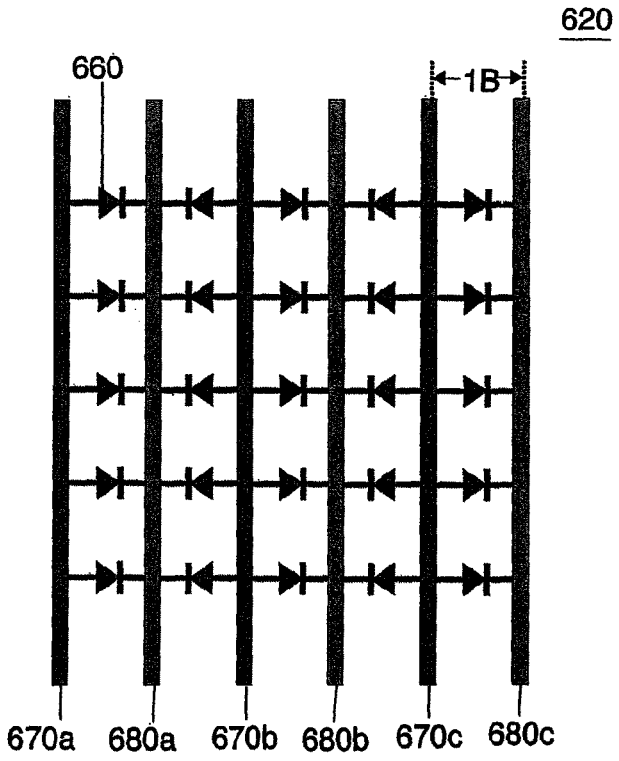

FIG. 1 depicts an arrangement of the antenna and radome;

FIG. 2*a* depicts a top view of the Jerusalem cross FSS;

FIG. 2*b* depicts a unit cell equivalent circuit of the Jerusalem cross FSS;

FIG. 2*c* depicts a transmission spectrum of the Jerusalem cross FSS;

FIG. 3*a* depicts a top view of the Inverse structure of the Jerusalem cross FSS;

FIG. 3*b* depicts a unit cell equivalent circuit of the Inverse structure of the Jerusalem cross FSS;

FIG. 3*c* depicts a transmission spectrum of the Inverse structure of the Jerusalem cross FSS;

FIG. 4 depicts an arrangement of the steerable antenna and tunable radome where the radome has an opaque region and a transparent region, and the antenna sending a microwave beam through the transparent region;

FIG. 5*a* depicts an inappropriate series LC unit cell equivalent circuit;

FIG. 5*b* depicts an appropriate parallel LC unit cell equivalent circuit;

FIG. 5*c* depicts an example of an appropriate TFSS unit cells;

FIG. 5*d* depicts an example of an appropriate TFSS unit cells;

FIG. 6*a* depicts a surface view of a circuit board containing conductors and varactors on both sides;

FIGS. 6*b-c* depict the front view of each surface of the circuit board in FIG. 6*a;*

Figure 6D:
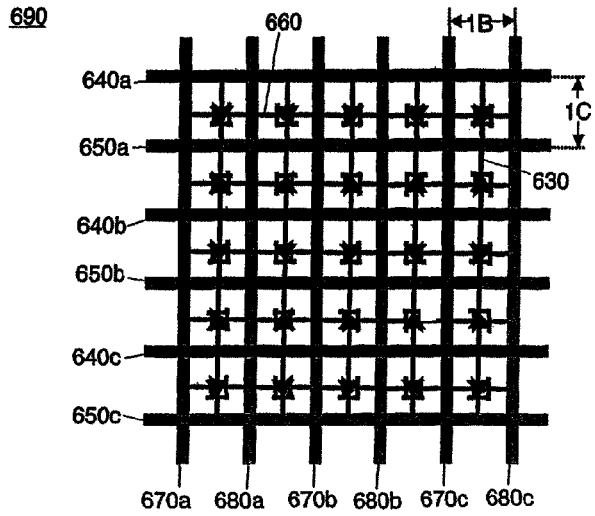

FIG. 6*d* depicts a transparent view of the first surface of the circuit board in FIG. 6*a* over the second surface of the circuit board in FIG. 6*a;*

Figure 6E:
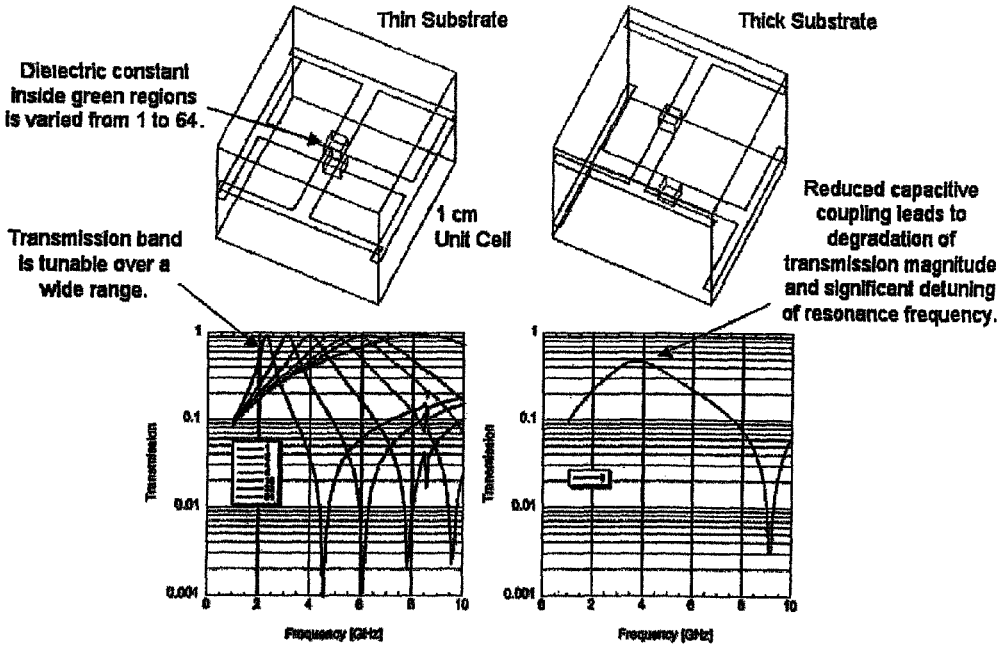
Figure 6F:
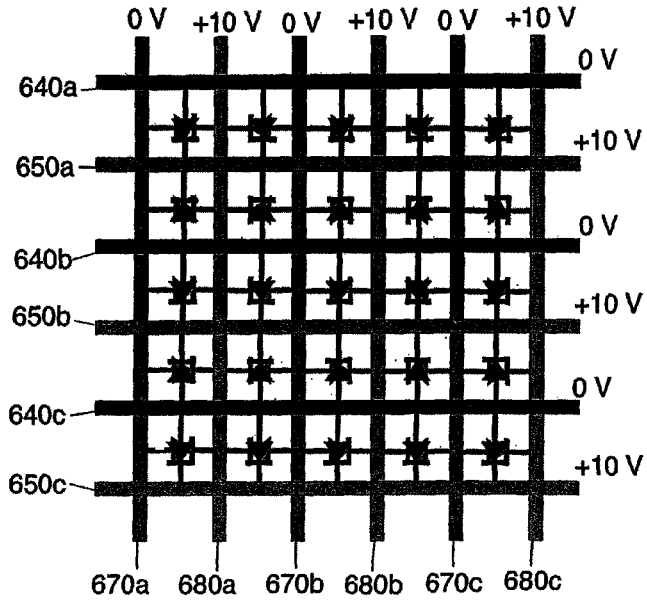
Figure 6G:
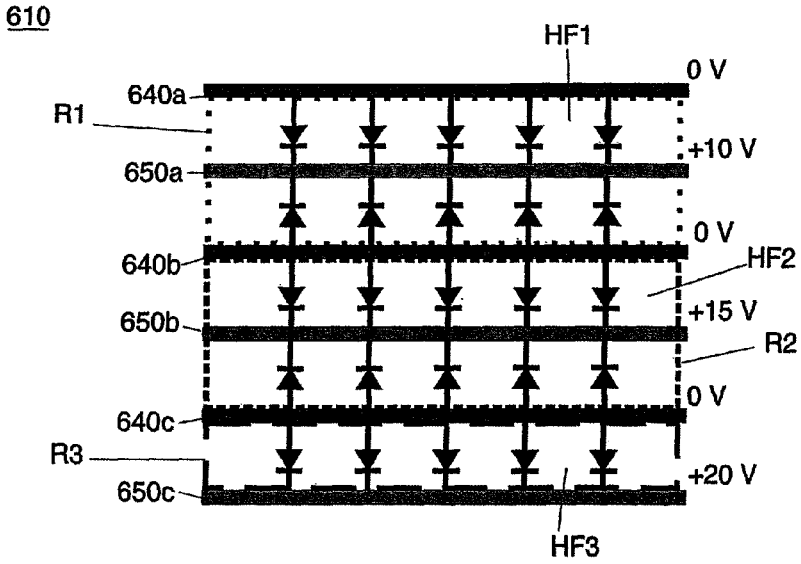
Figure 6H:
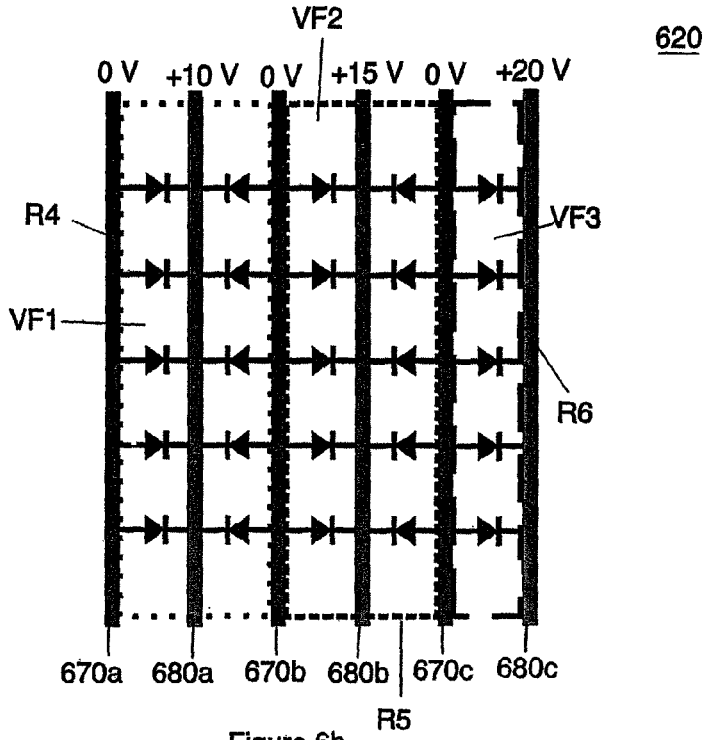
Figure 6I:
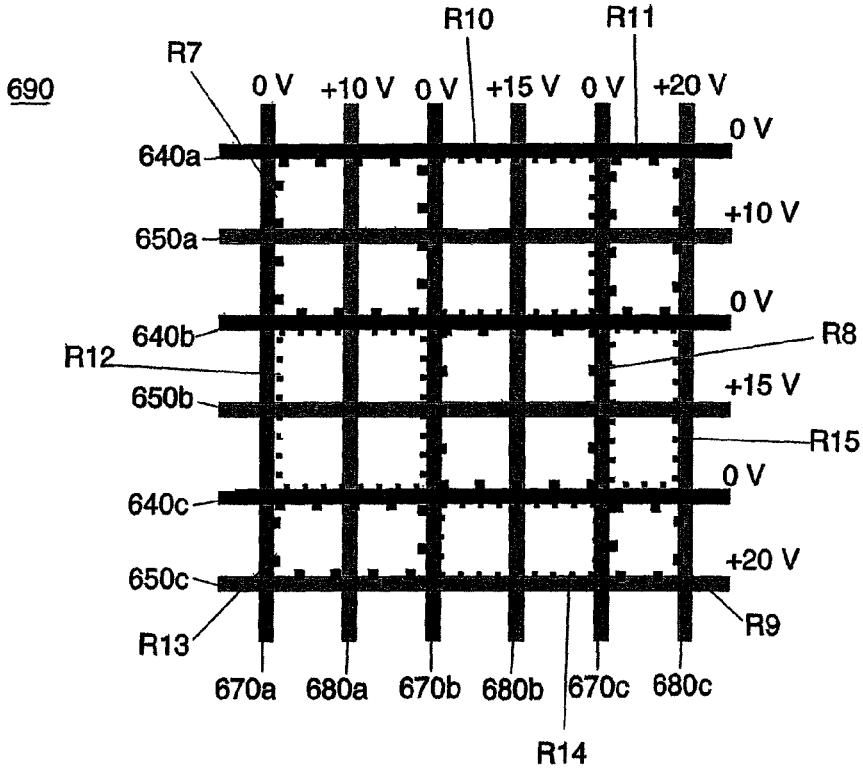

FIG. 6*e* depicts the results of modeling the circuit board in FIG. 6*a* on the Ansoft HFSS software;

FIG. 6*f* depicts tuning both sides of the circuit board in FIG. 6*a* to a resonance frequency;

FIG. 6*g* depicts tuning the first surface of the circuit board in FIG. 6*a* to three different resonance frequencies;

FIG. 6*h* depicts tuning the second surface of the circuit board in FIG. 6*a* to three different frequencies;

FIG. 6*i* depicts a transparent view of the first surface over the second surface and the propagation of different resonance frequencies through the circuit board in FIG. 6*a;*

Figure 6J:
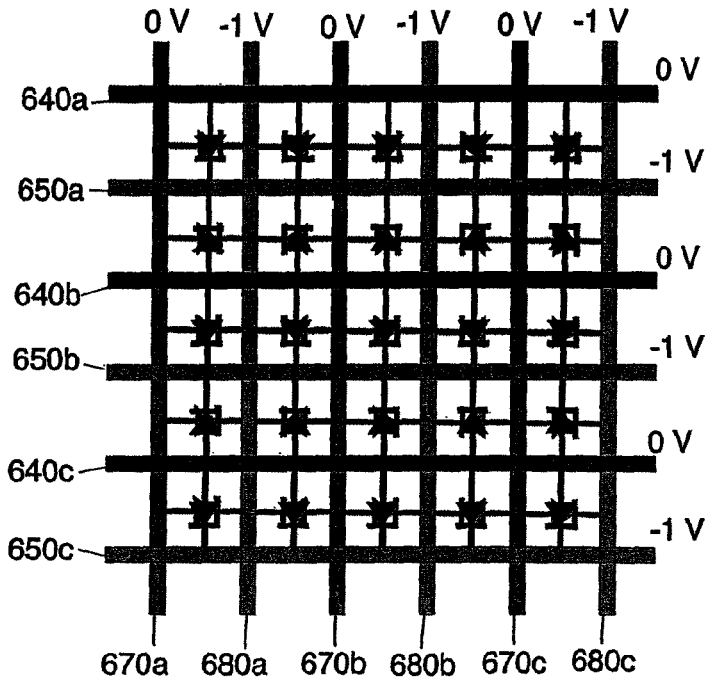
Figure 6K:
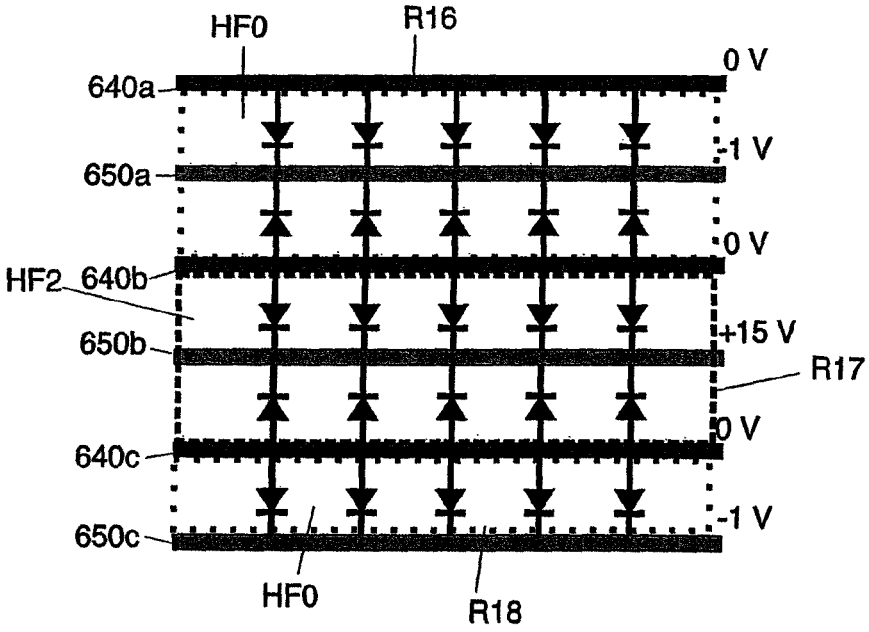
Figure 6L:
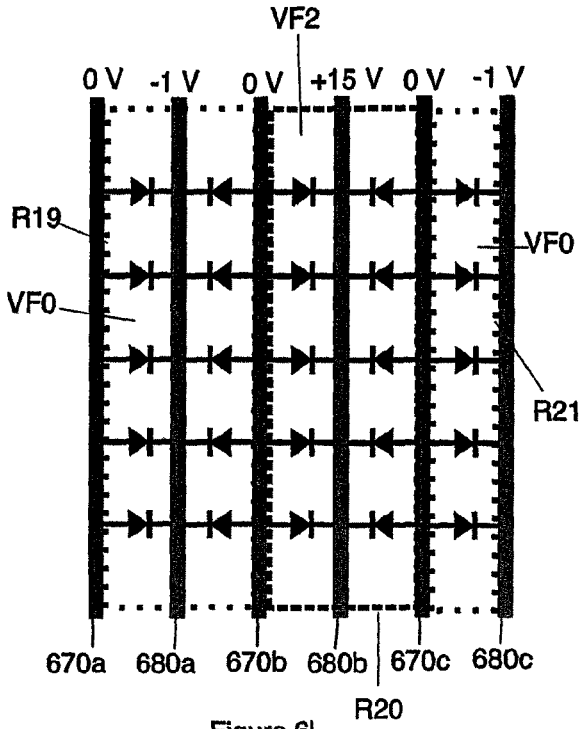
Figure 6M:
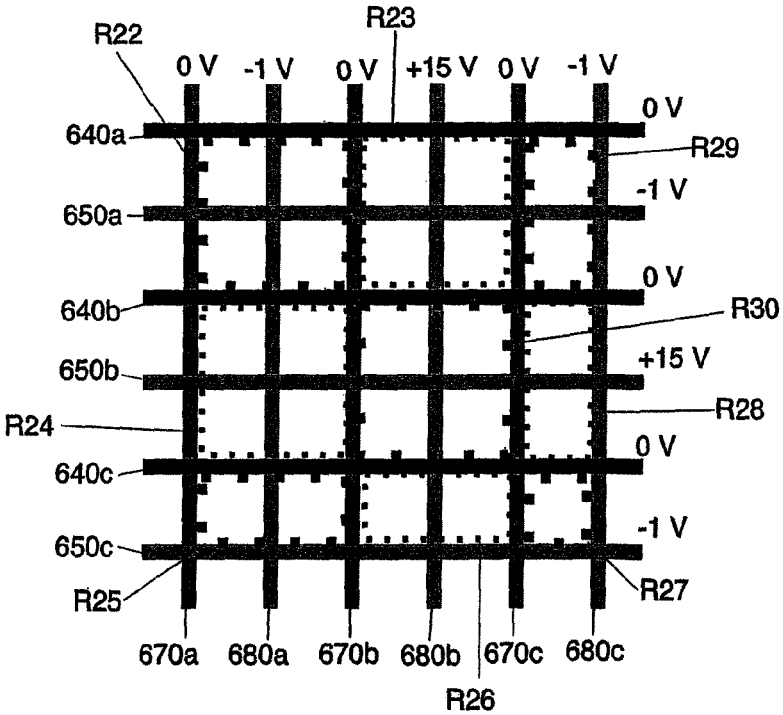

FIG. 6*j* depicts setting the circuit board in FIG. 6*a* to an opaque state;

FIG. 6*k* depicts tuning a region of the first surface to one frequency and setting the remaining region of the first surface in opaque mode;

FIG. 6*l* depicts tuning a region of the second surface to one frequency and setting the remaining region of the second surface in opaque mode;

FIG. 6*m* depicts a transparent view of the first surface over the second surface and the propagation of frequency and opaque mode through the circuit board in FIG. 6*a;*

Figure 7A:
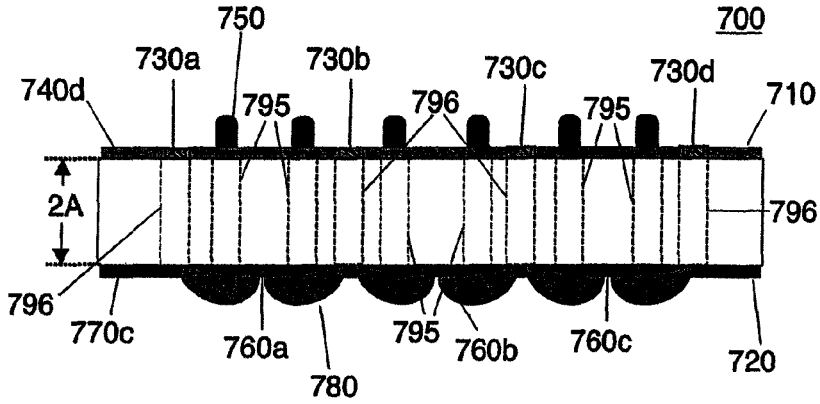
Figure 7B:
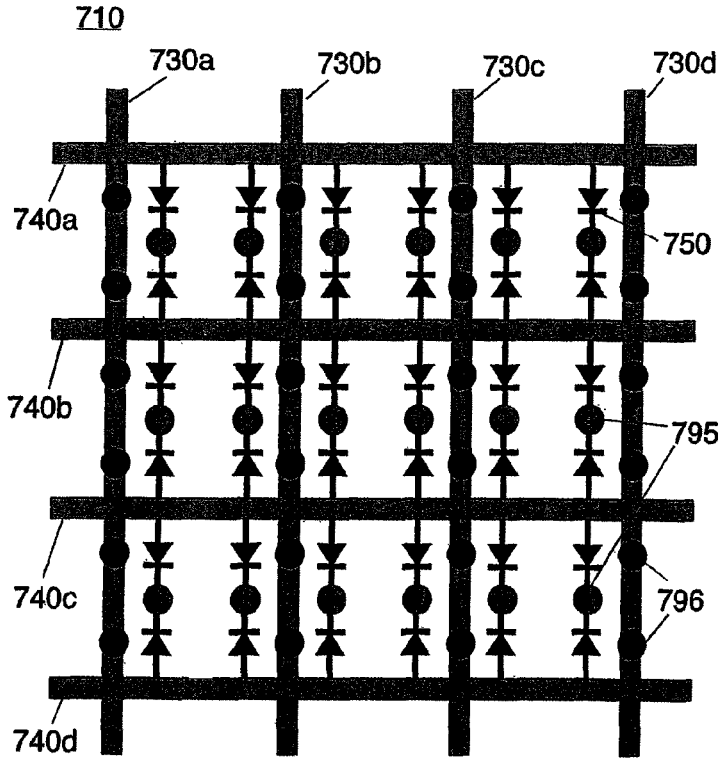
Figure 7C:
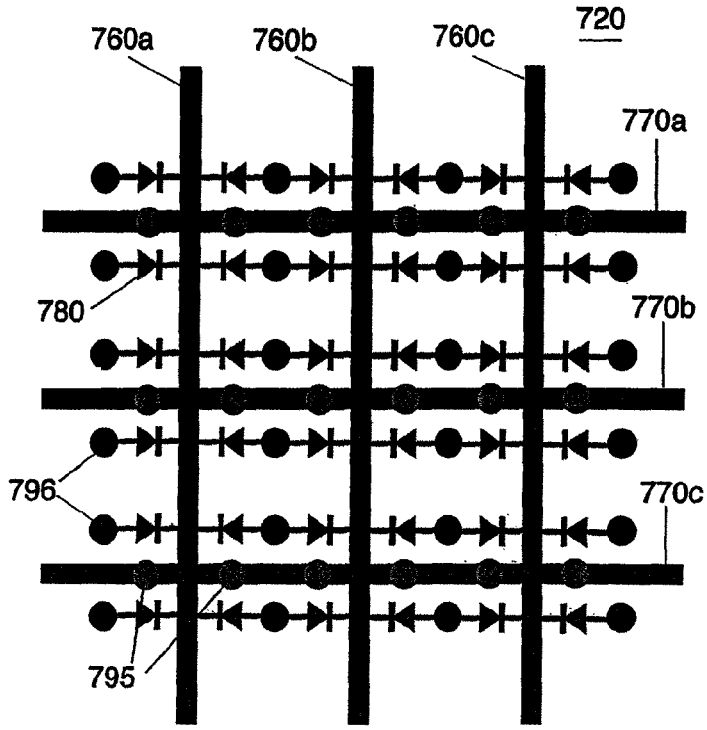

FIG. 7*a* depicts a surface view of a circuit board containing conductors and varactor on both sides;

FIGS. 7*b-c* depict the front view of each surface of the circuit board in FIG. 7*a;*

Figure 7D:
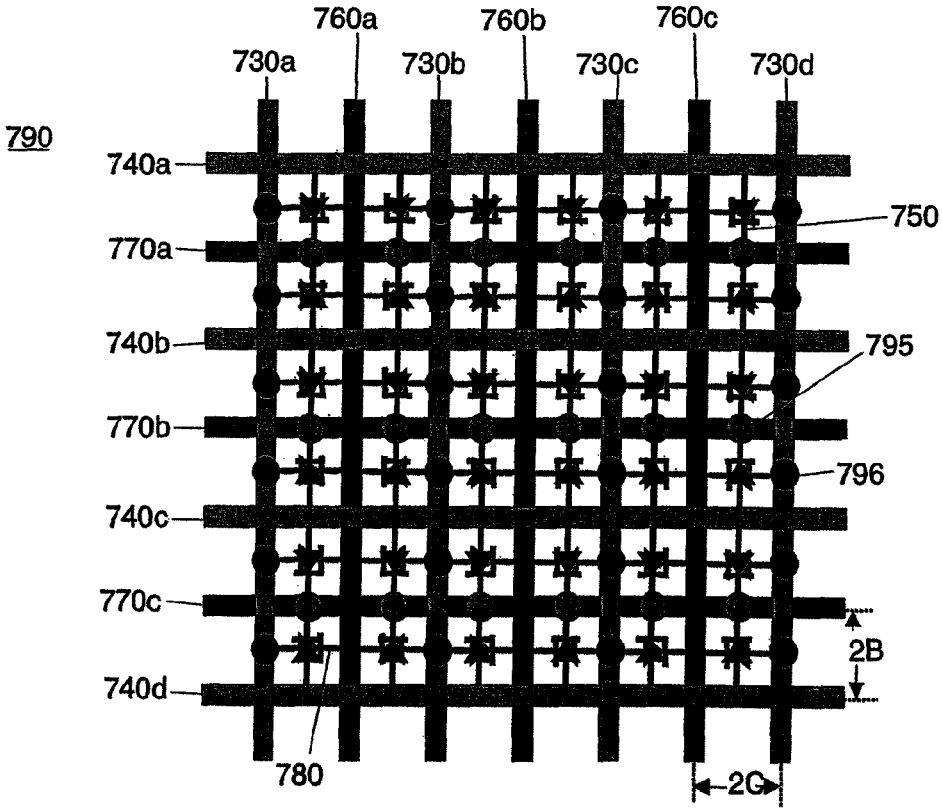

FIG. 7*d* depicts a transparent view of the first surface of the circuit board in FIG. 7*a* over the second surface of the circuit board in FIG. 7*a;*

Figure 7E:
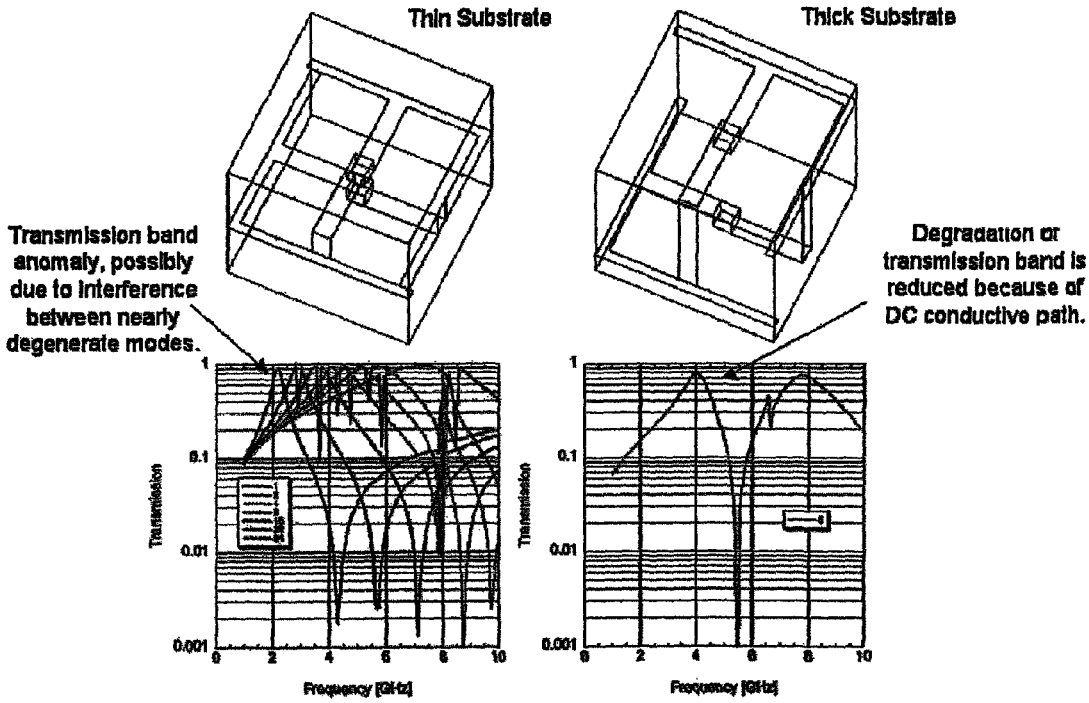
Figure 7F:
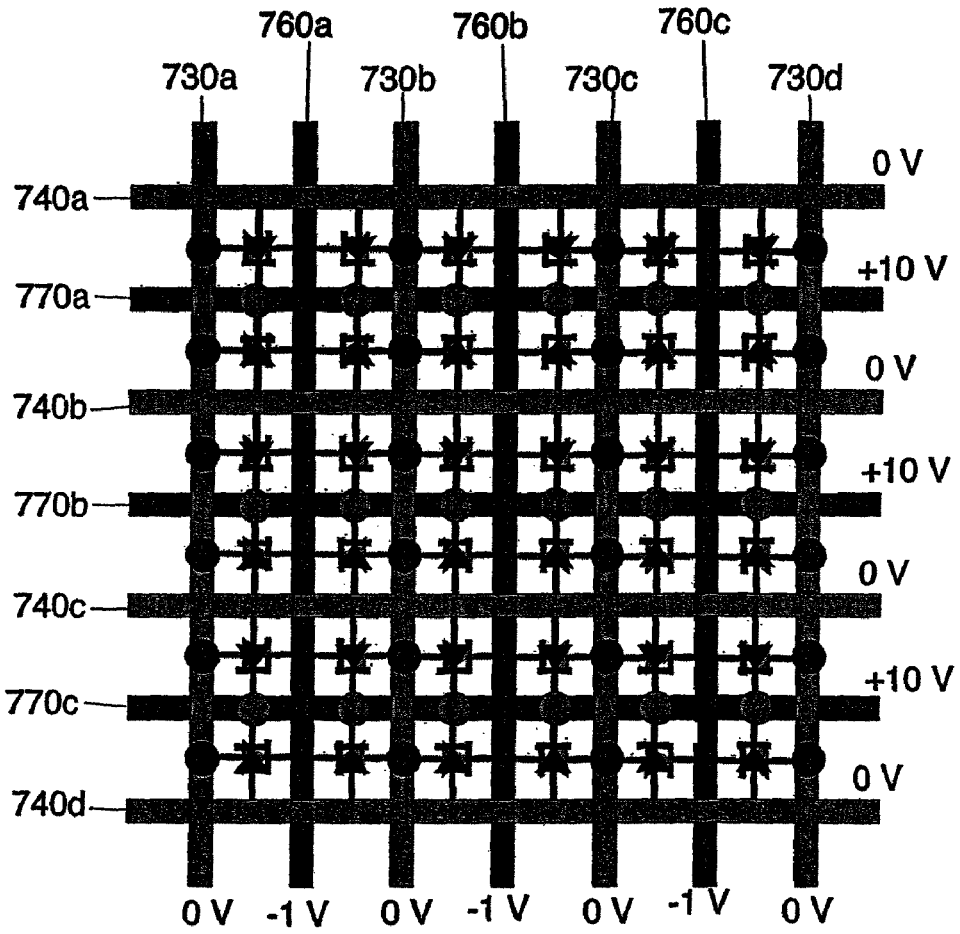
Figure 7G:
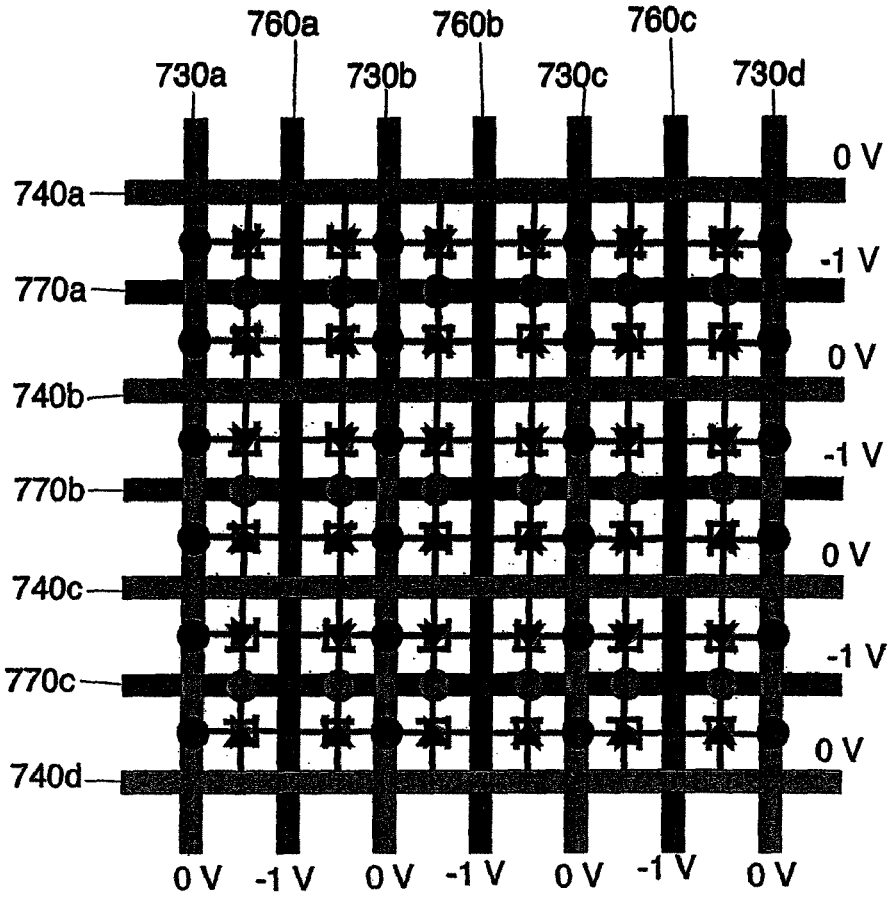
Figure 8A:
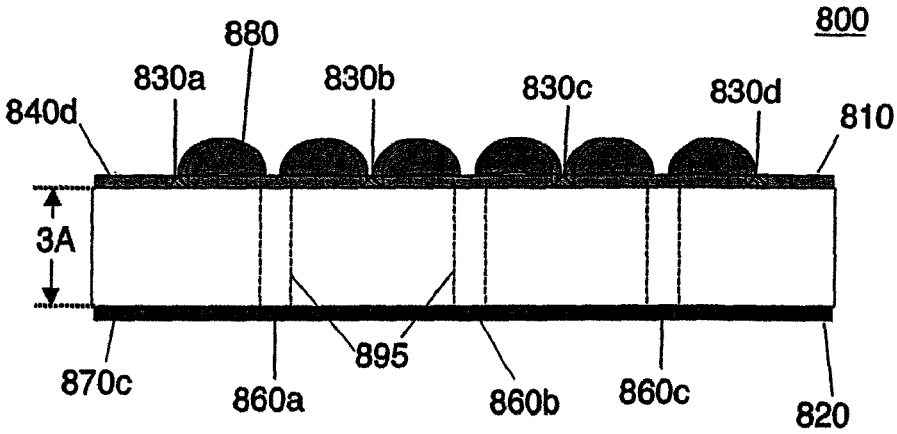
Figure 8B:
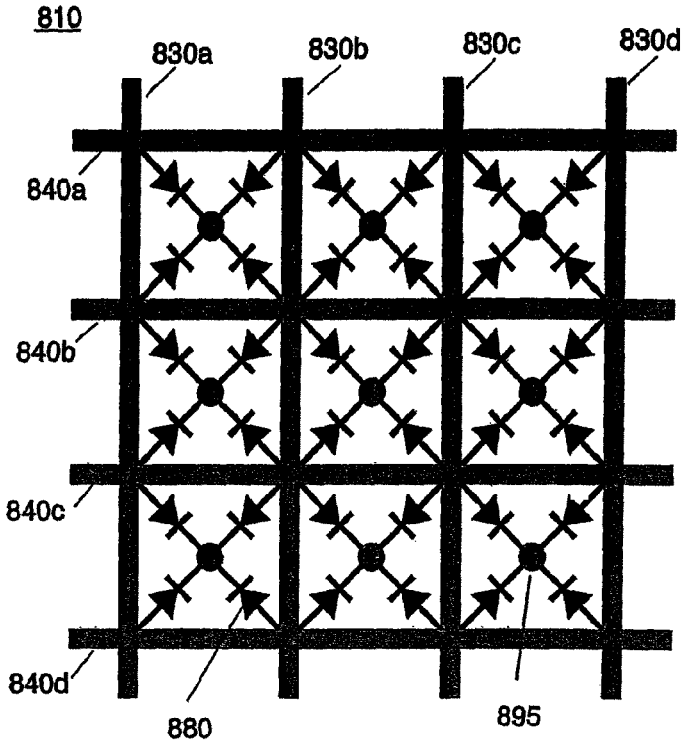
Figure 8C:
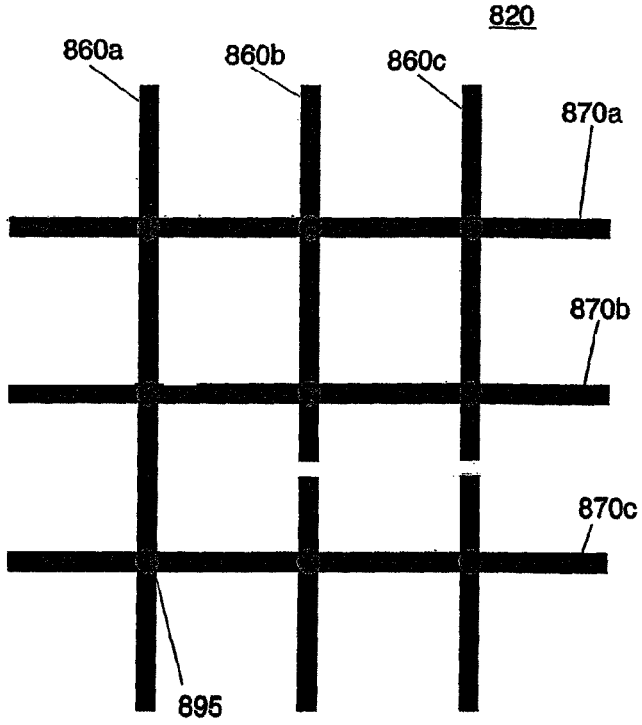

FIG. 7*e* depicts the results of modeling the circuit board in FIG. 7*a* on the Ansoft HFSS software;

FIG. 7*f* depicts tuning both sides of the circuit board in FIG. 7*a* to a resonance frequency;

FIG. 7*g* depicts setting the circuit board in FIG. 7*a* to an opaque state;

FIG. 8*a* depicts a surface view of a circuit board containing conductors and varactor on the first surface, conductors on the second surface and vias connecting first and second surface;

FIGS. 8*b-c* depict the front view of each surface of the circuit board in FIG. 8*a;*

Figure 8D:
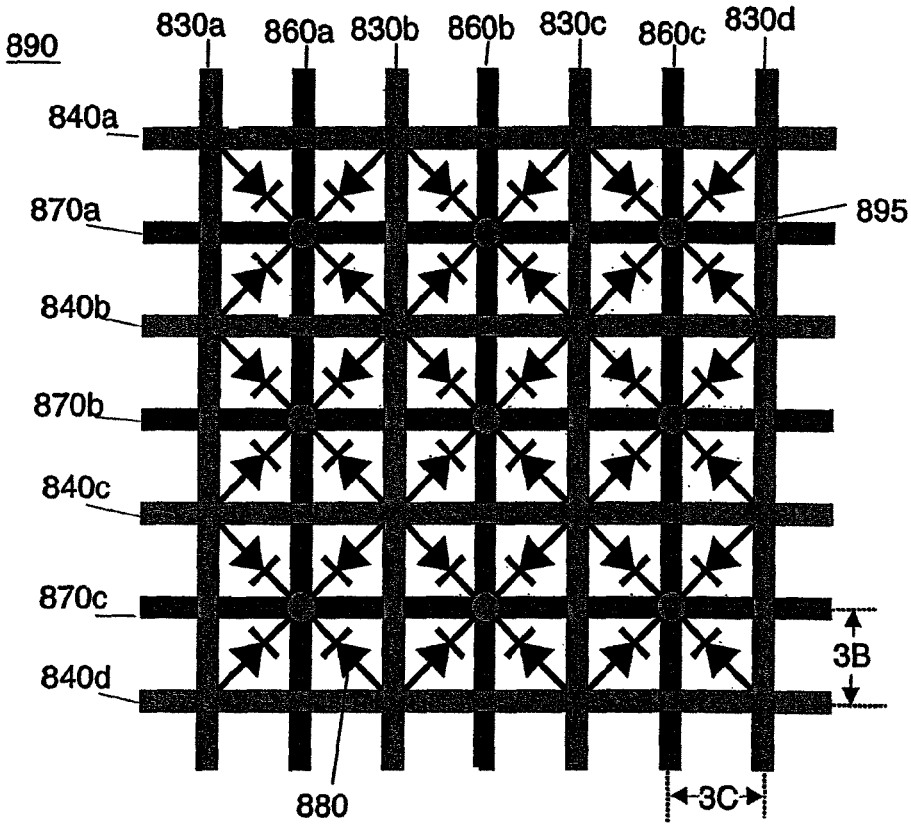

FIG. 8*d* depicts a transparent view of the first surface of the circuit board in FIG. 8*a* over the second surface of the circuit board in FIG. 8*a;*

Figure 8E:
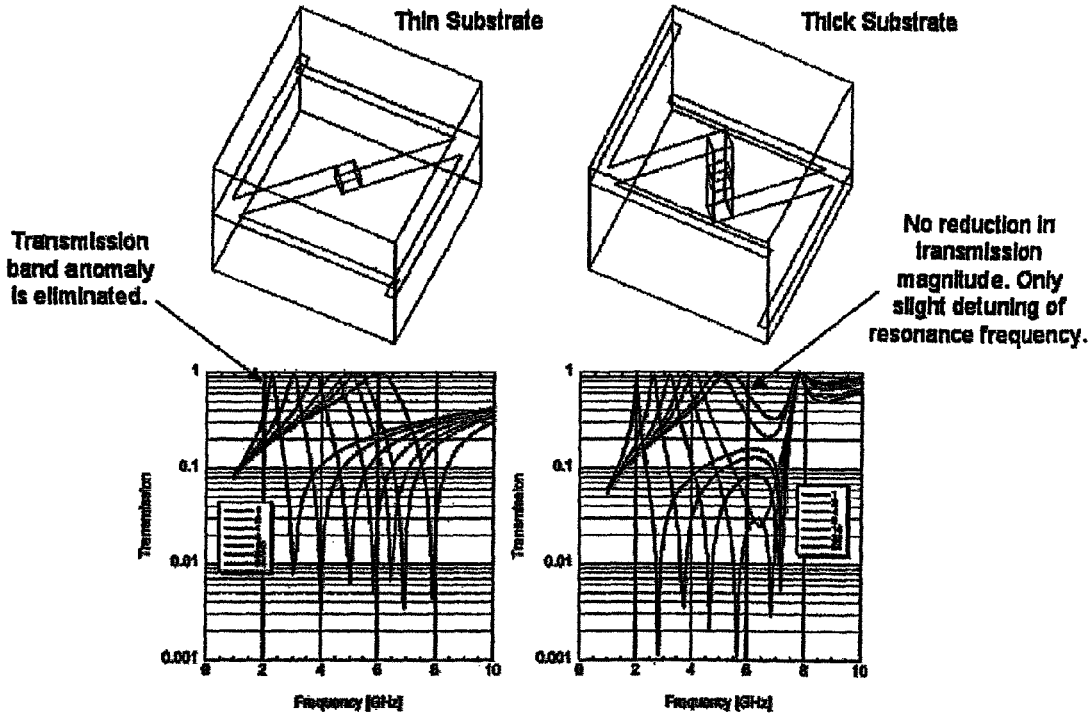
Figure 8F:
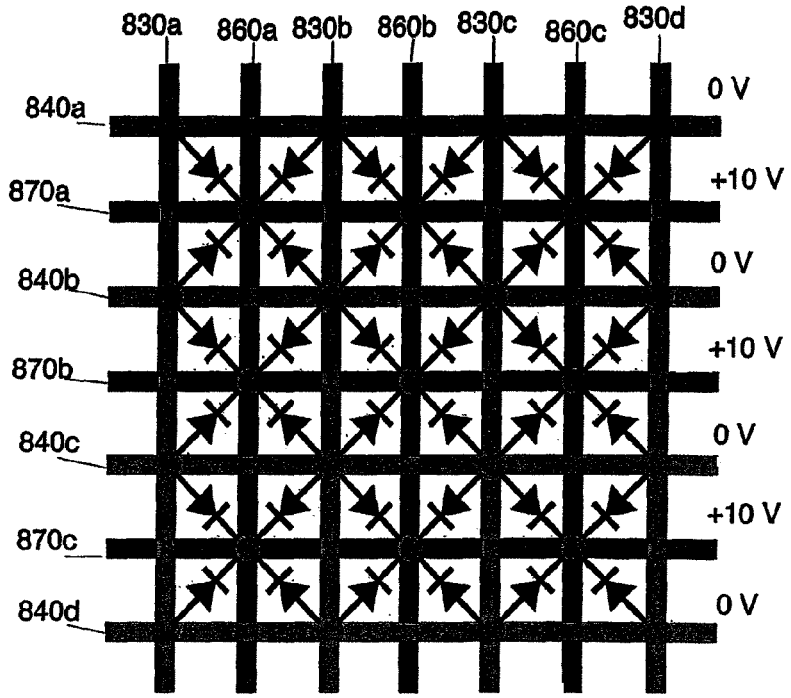
Figure 8G:
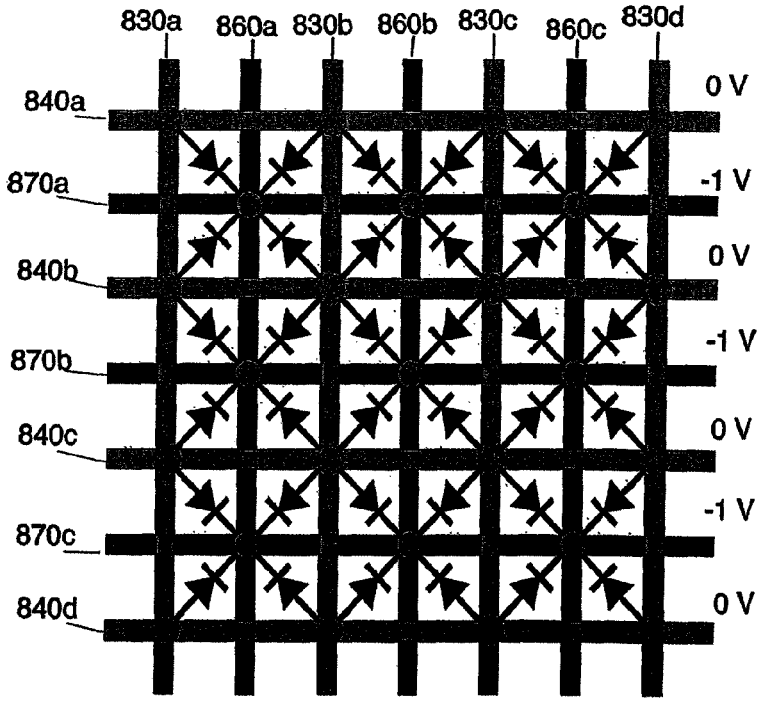
Figure 9A:
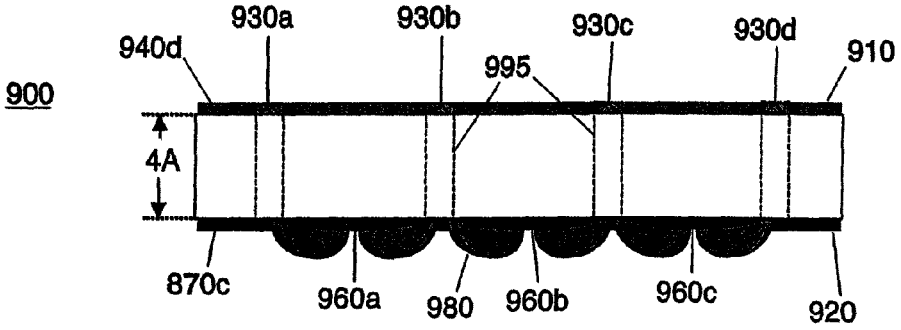
Figure 9B:
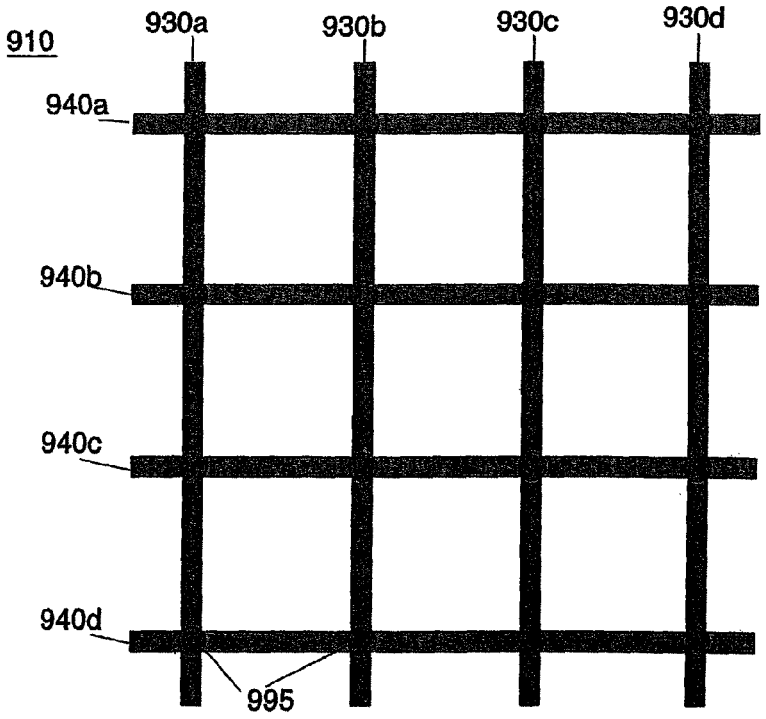
Figure 9C:
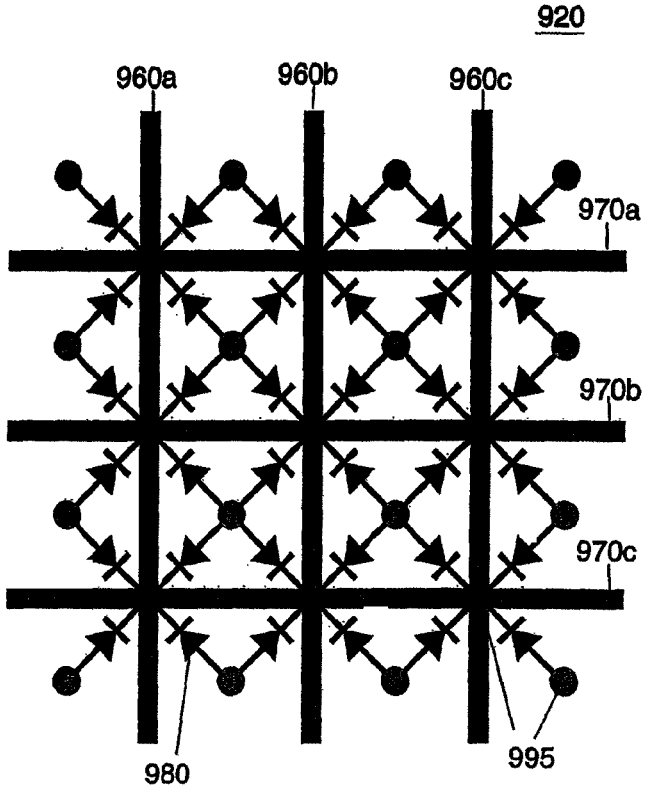

FIG. 8*e* depicts the results of modeling the circuit board in FIG. 8*a* on the Ansoft HFSS software;

FIG. 8*f* depicts tuning both sides of the circuit board in FIG. 8*a* to a resonance frequency;

FIG. 8*g* depicts setting the circuit board in FIG. 8*a* to an opaque state;

FIG. 9*a* depicts a surface view of a circuit board containing conductors on the first surface, conductors and varactor on the second surface and vias connecting the first and the second surface;

FIGS. 9*b-c* depict the front view of each surface of the circuit board in FIG. 9*a;*

Figure 9D:
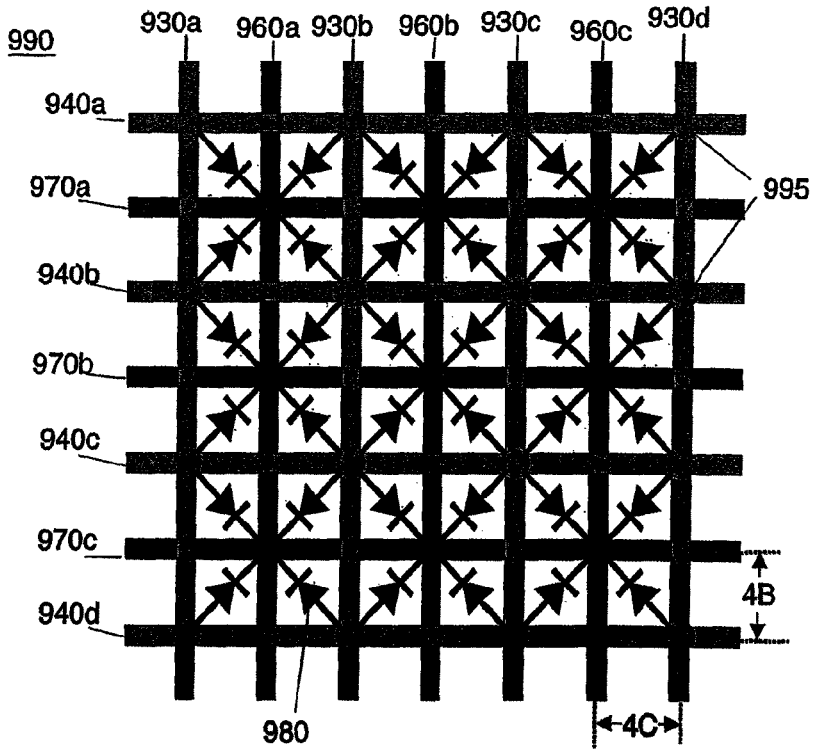

FIG. 9*d* depicts a transparent view of the first surface of the circuit board in FIG. 9*a* over the second surface of the circuit board in FIG. 9*a;*

Figure 10A:
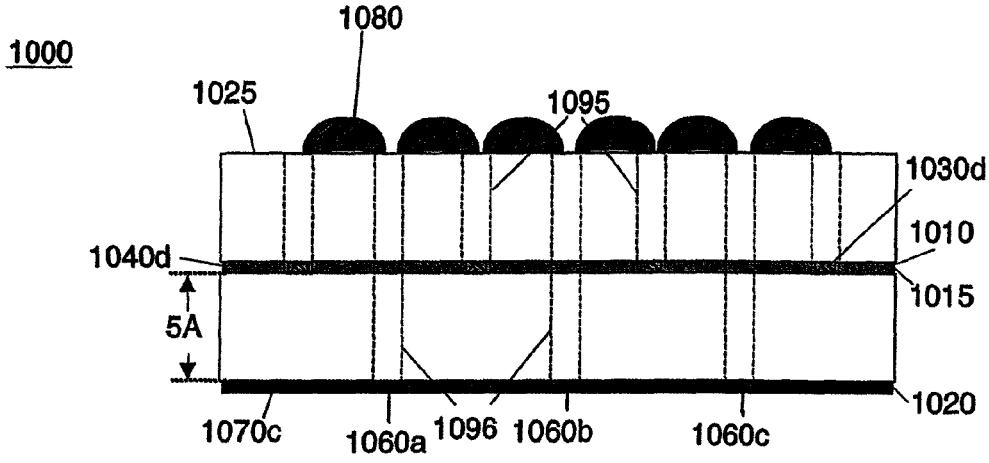
Figure 10B:
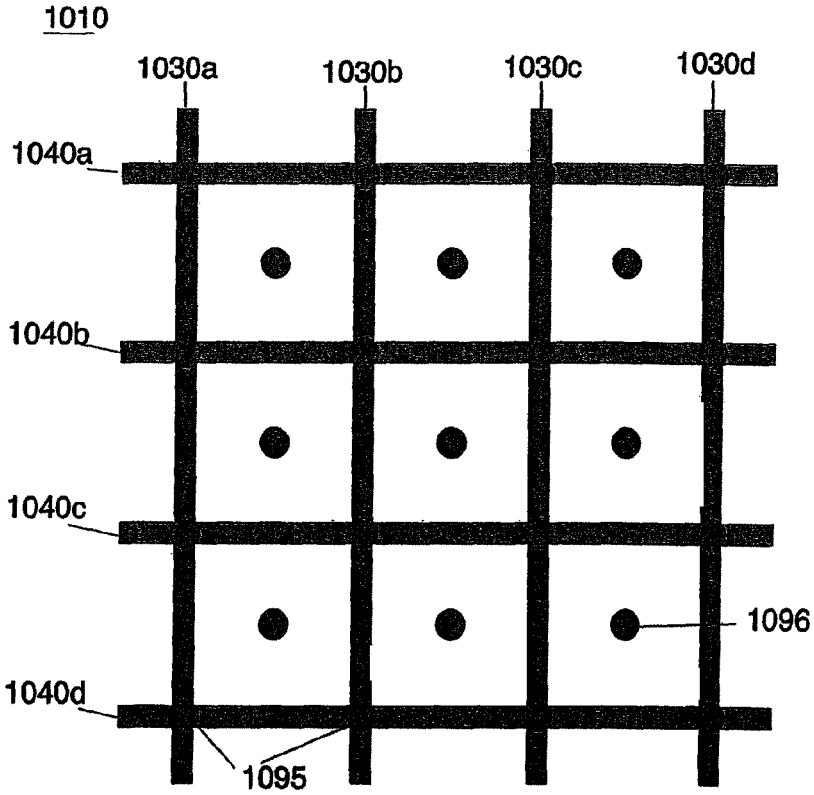
Figure 10C:
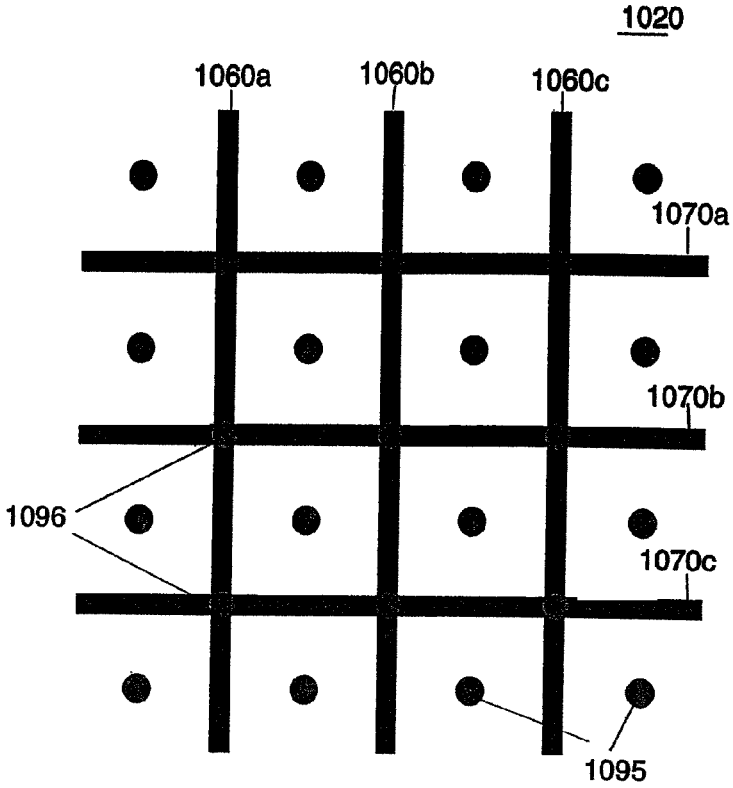
Figure 10D:
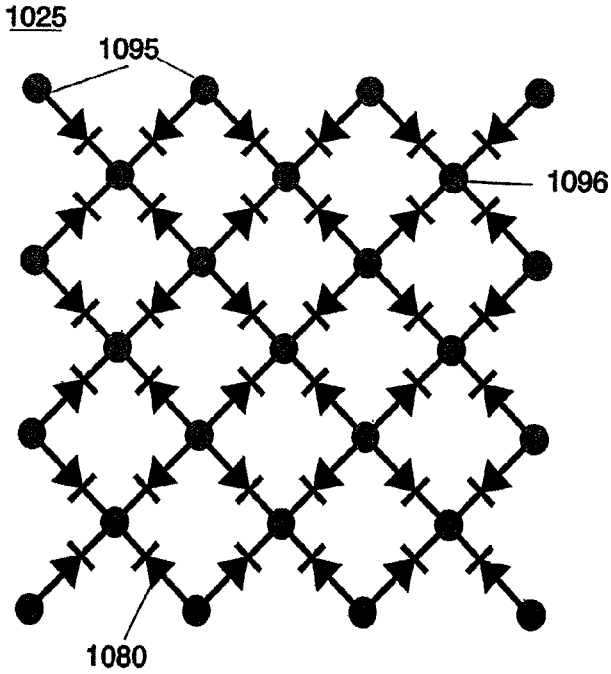

FIG. 10*a* depicts a surface view of a circuit board containing varactors on the first layer, conductors on the second and third layers and vias connecting all the layers;

FIGS. 10*b-d* depict the front view of each layer of the circuit board in FIG. 10*a;*

Figure 10E:
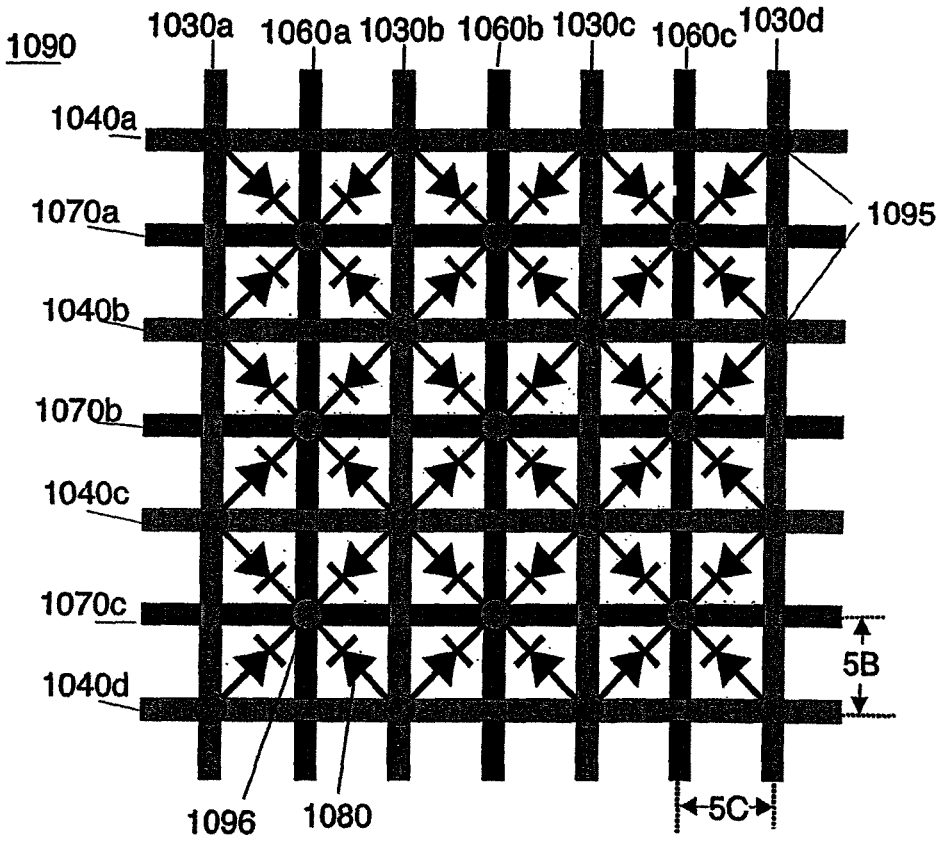

FIG. 10*e* depicts a transparent view of the first layer of the circuit board in FIG. 10*a* over the second layer of the circuit board in FIG. 10*a* over the third layer of the circuit board in FIG. 10*a;*

Figure 11A:
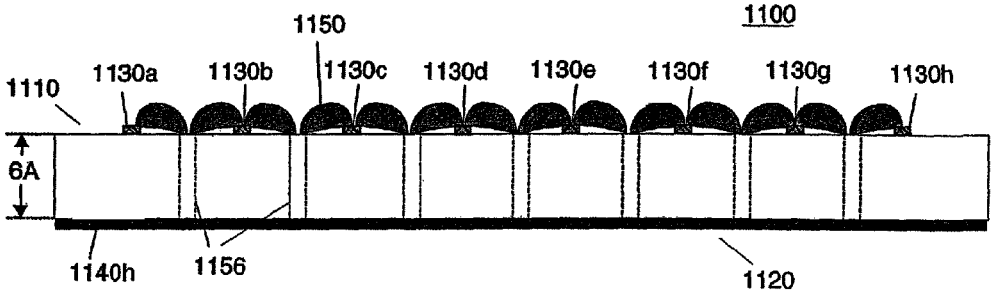
Figure 11B:
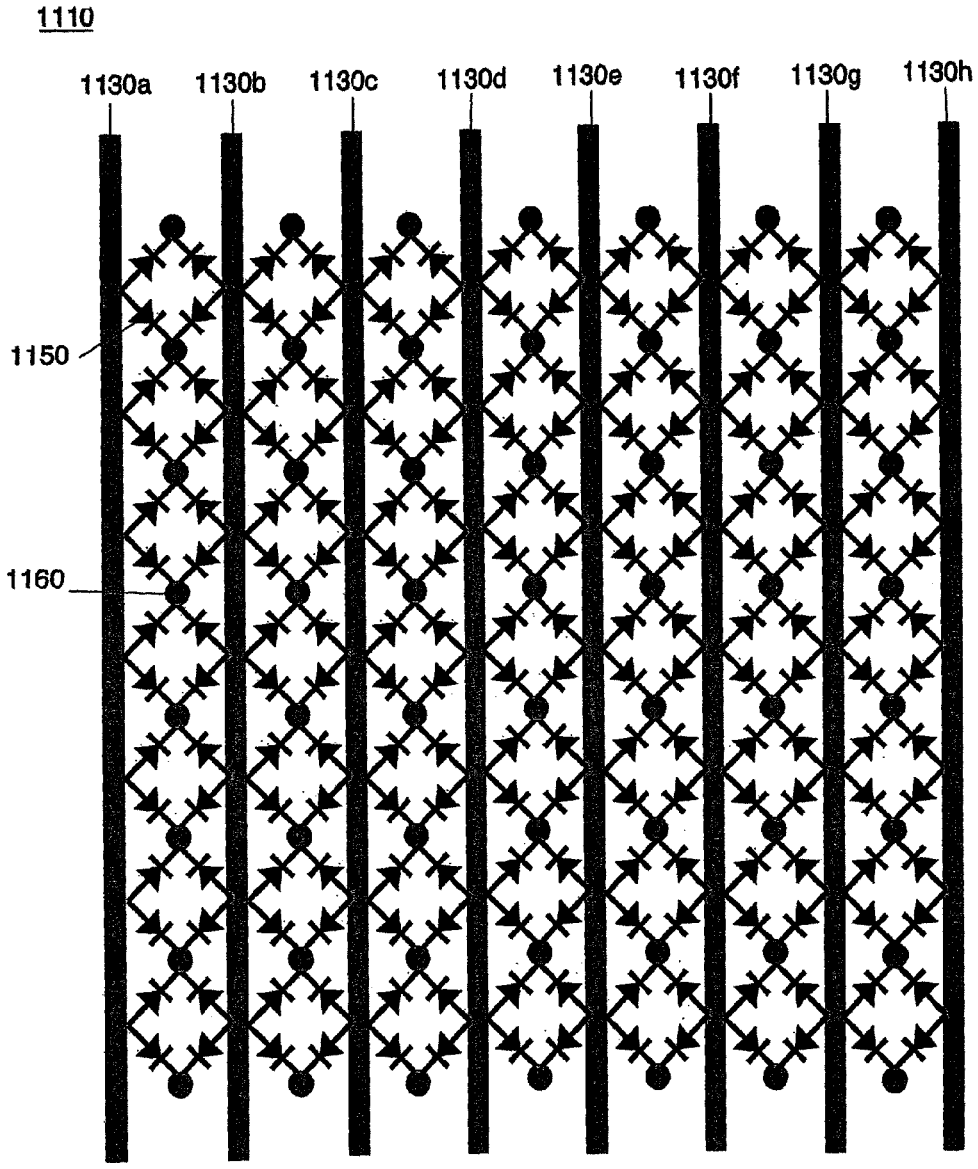
Figure 11C:
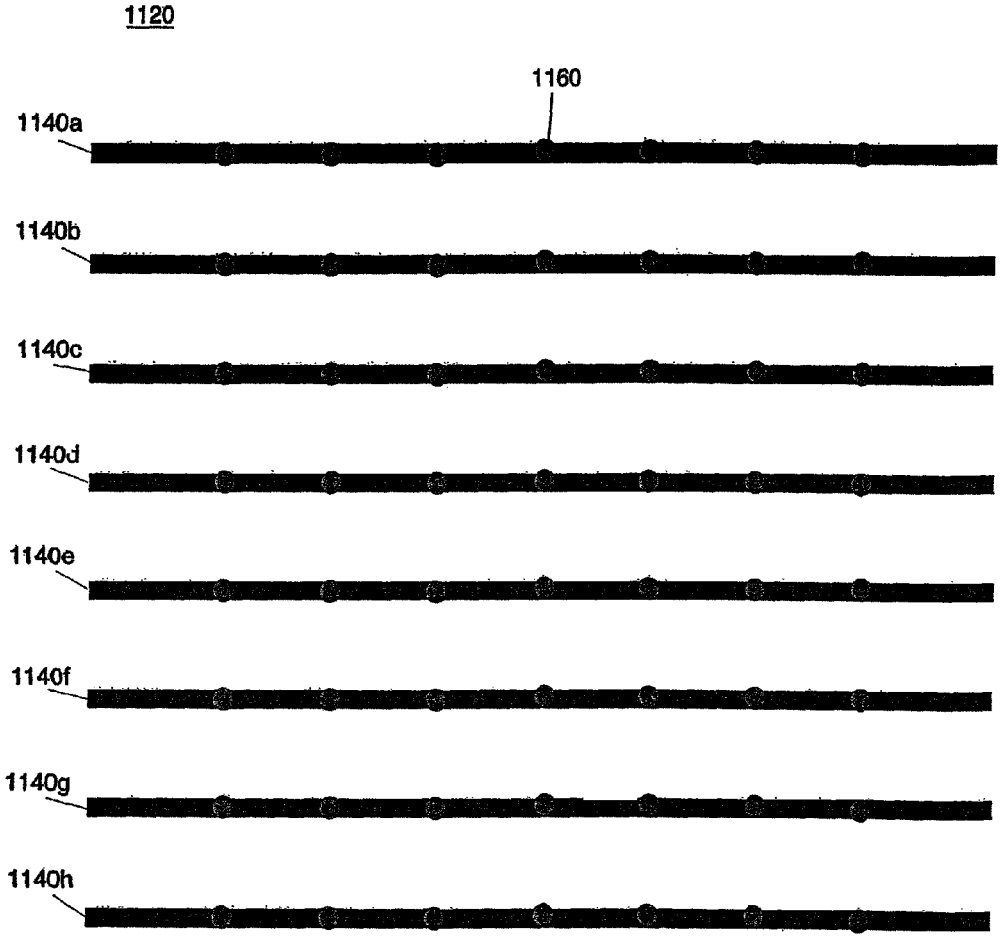

FIG. 11*a* depicts a surface view of a circuit board containing conductors and varactors on the first surface, conductors on the second surface and vias connecting first surface and second surface;

FIGS. 11*b-c* depict the front view of each surface of the circuit board in FIG. 11*a;*

Figure 11D:
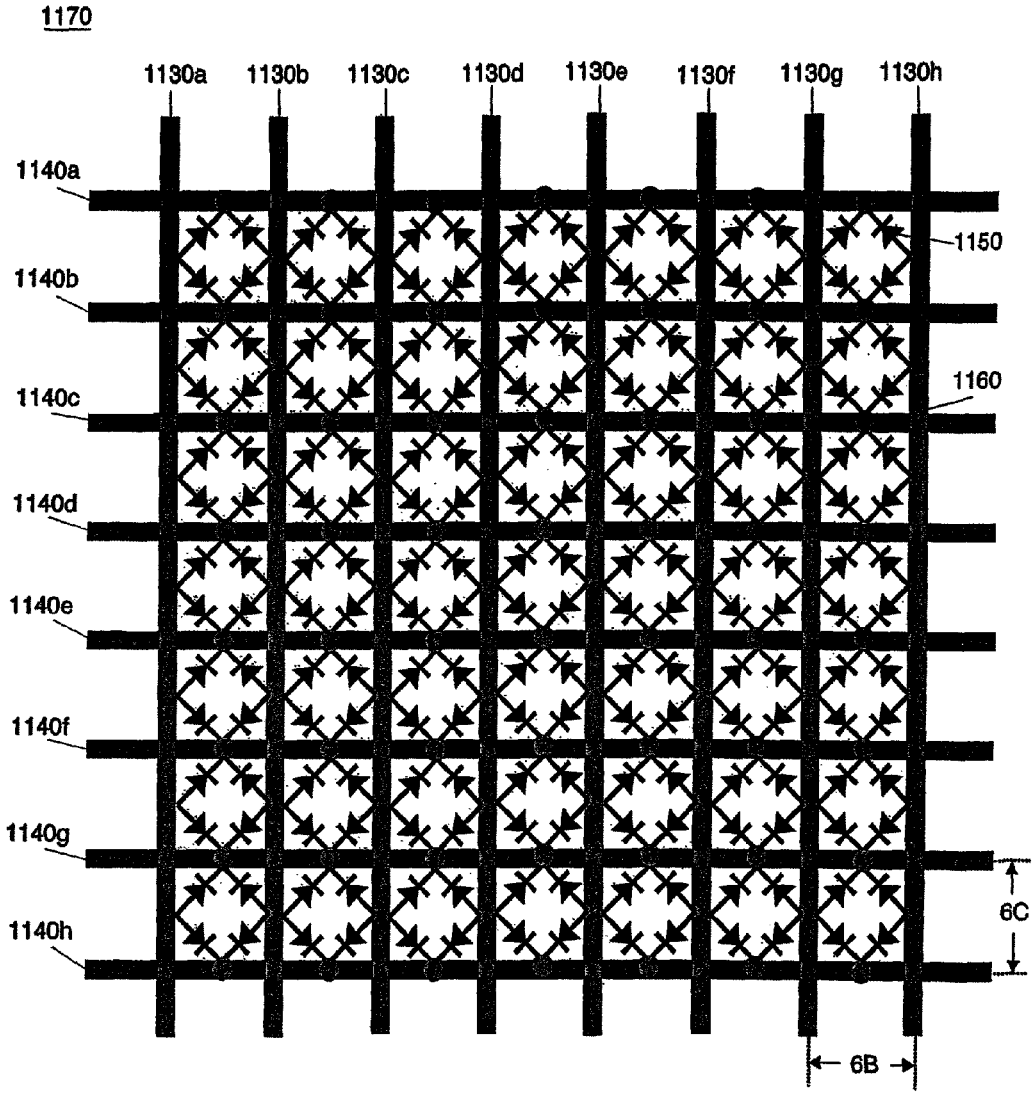

FIG. 11*d* depicts a transparent view of the first surface of the circuit board in FIG. 11*a* over the second surface of the circuit board in FIG. 11*a;*

Figure 11E:
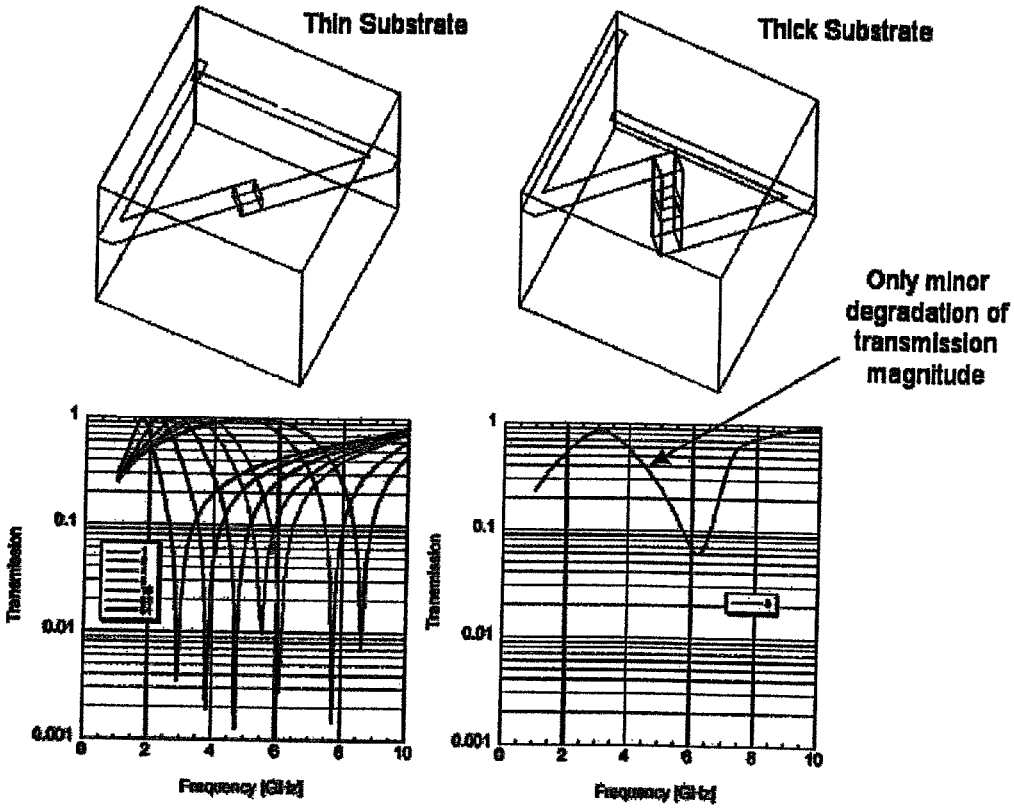
Figure 11F:
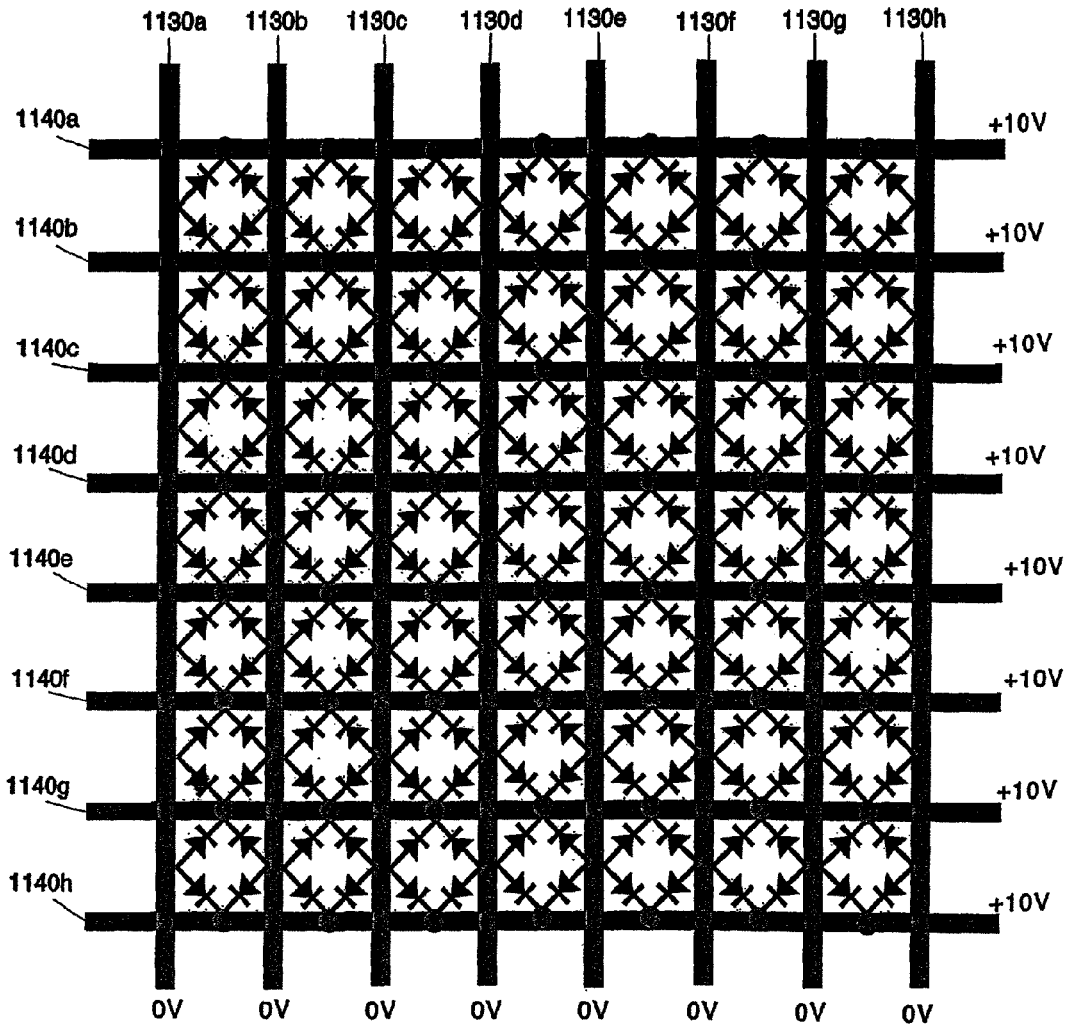
Figure 11G:
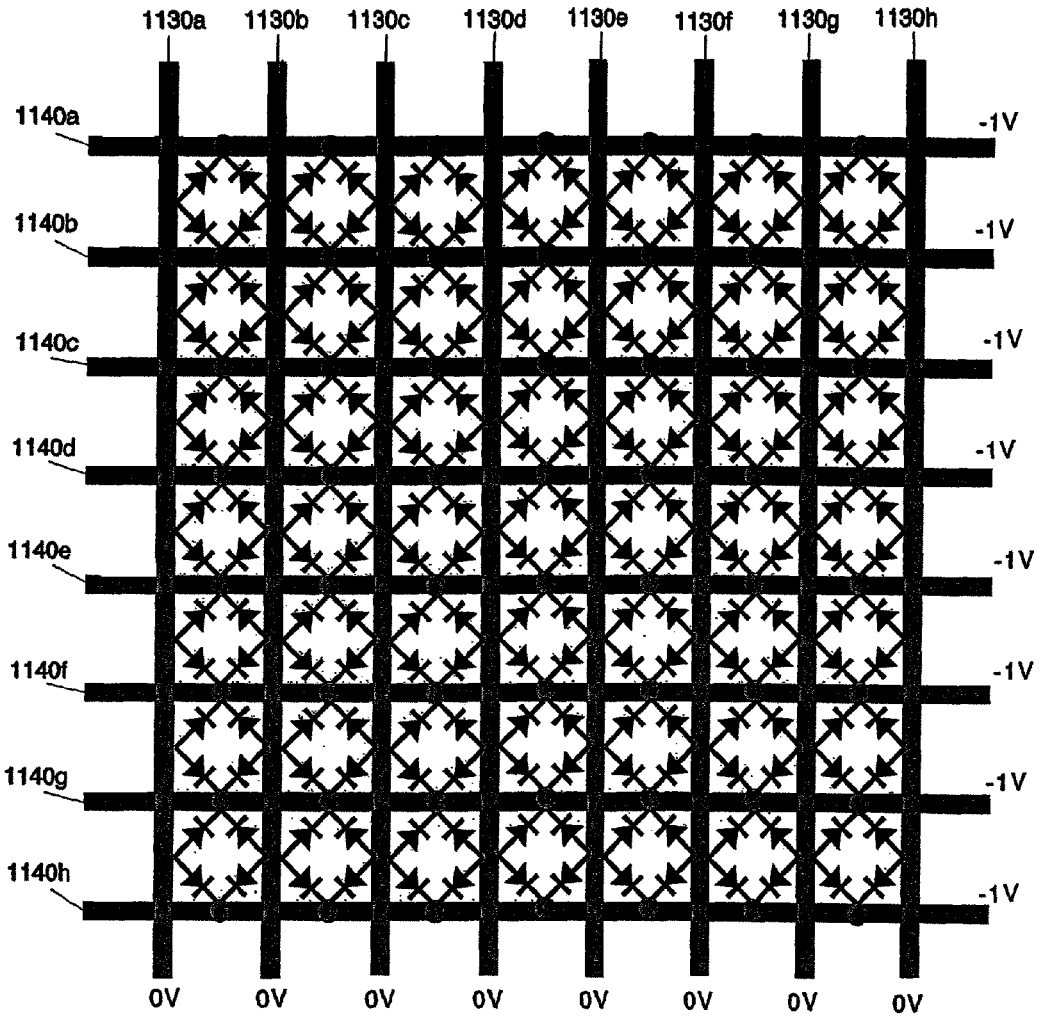
Figure 11H:
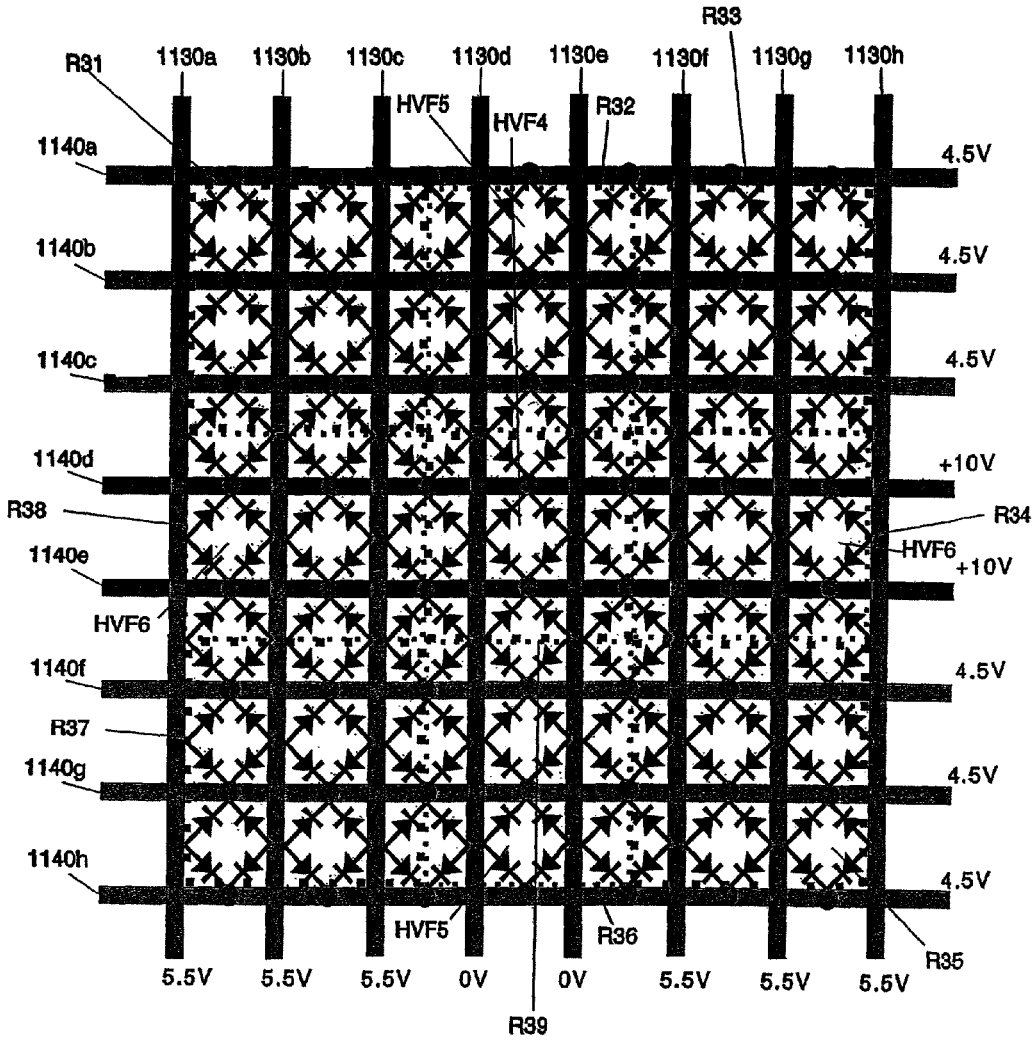
Figure 12A:
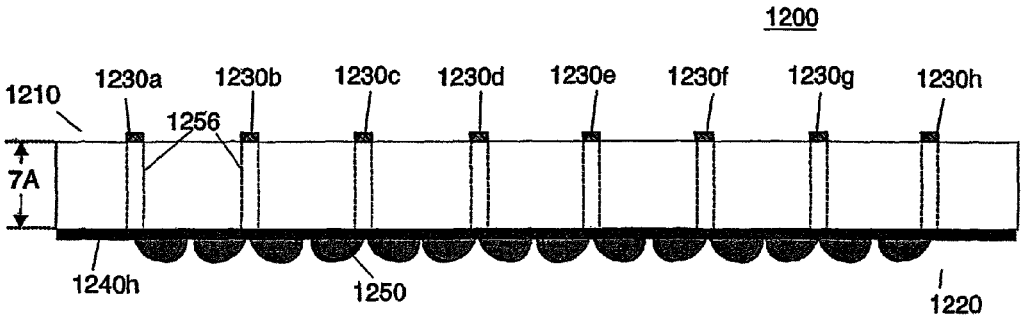

FIG. 11*e* depicts the results of modeling circuit board in FIG. 11*a* on the Ansoft HFSS software;

FIG. 11*f* depicts tuning the circuit board in FIG. 11*a* to a resonance frequency;

FIG. 11*g* depicts setting the circuit board in FIG. 11*a* to an opaque state;

FIG. 11*h* depicts tuning the circuit board in FIG. 6*a* to three different frequencies and an opaque state;

FIG. 12*a* depicts a surface view of a circuit board containing conductors on the first surface, conductors and varactors on the second surface and vias connecting the first surface and second surface.

Figure 12B:
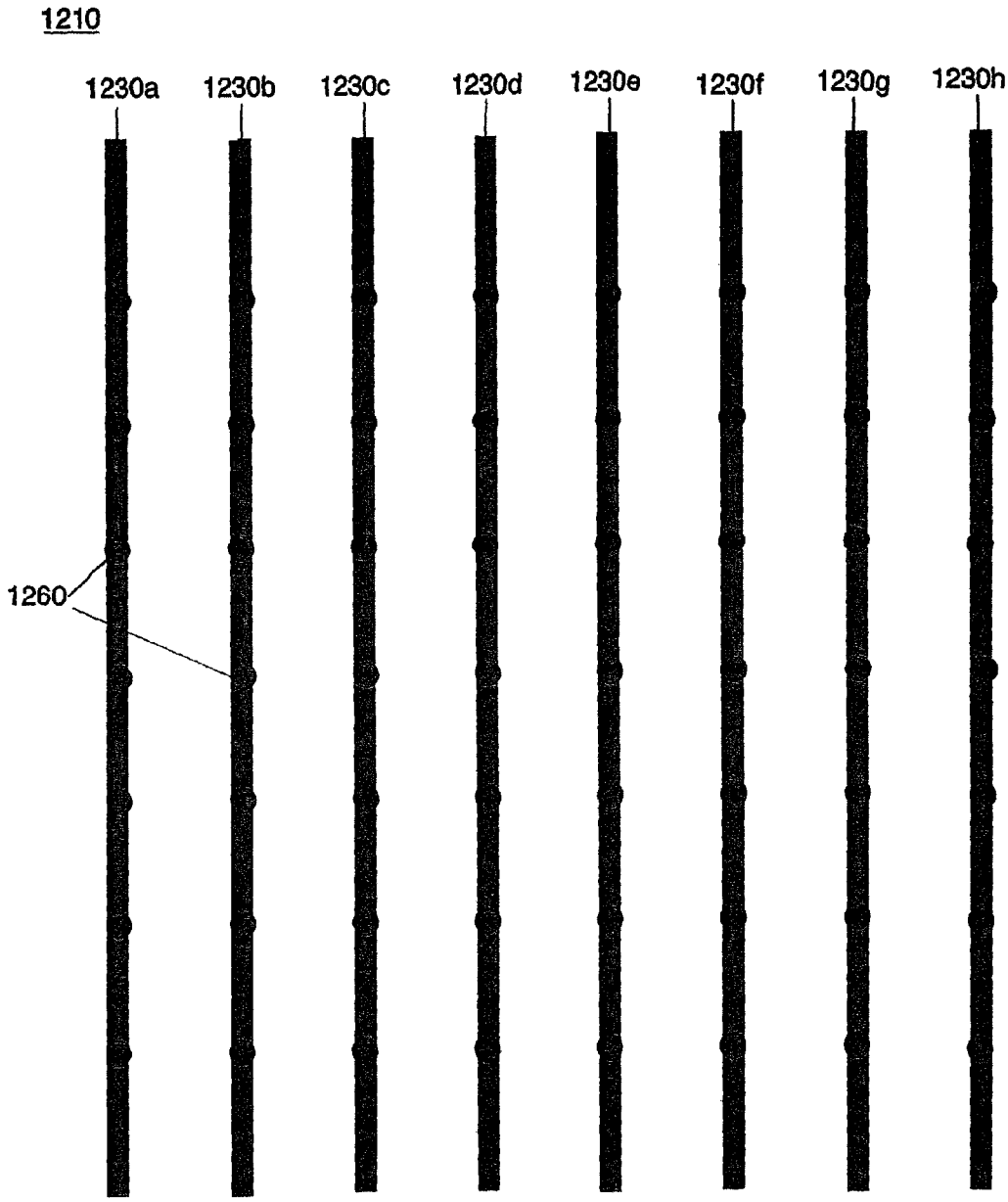
Figure 12C:
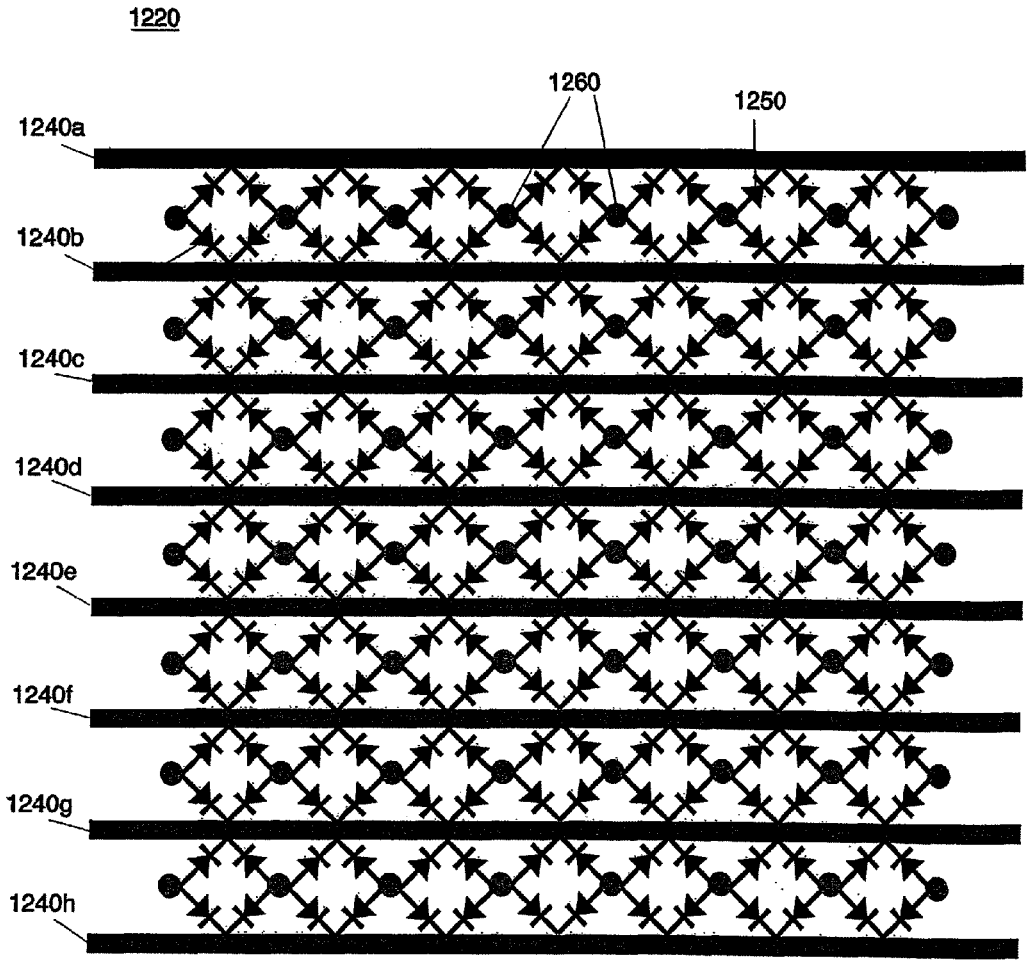

FIGS. 12*b-c* depict the front view of each surface of the circuit board in FIG. 11*a;*

Figure 12D:
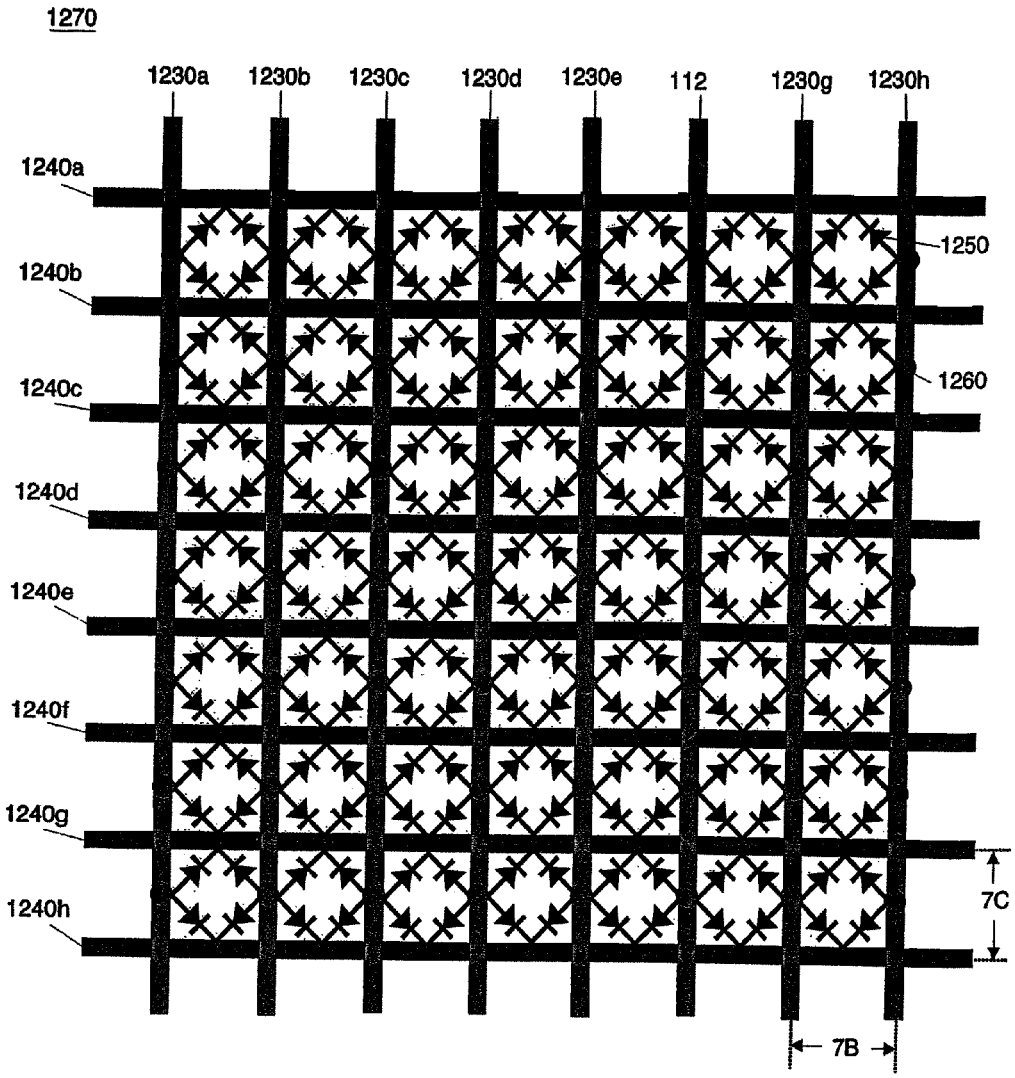

FIG. 12*d* depicts a transparent view of the first surface of the circuit board in FIG. 12*a* over the second surface of the circuit board in FIG. 12*a;*

Figure 13A:
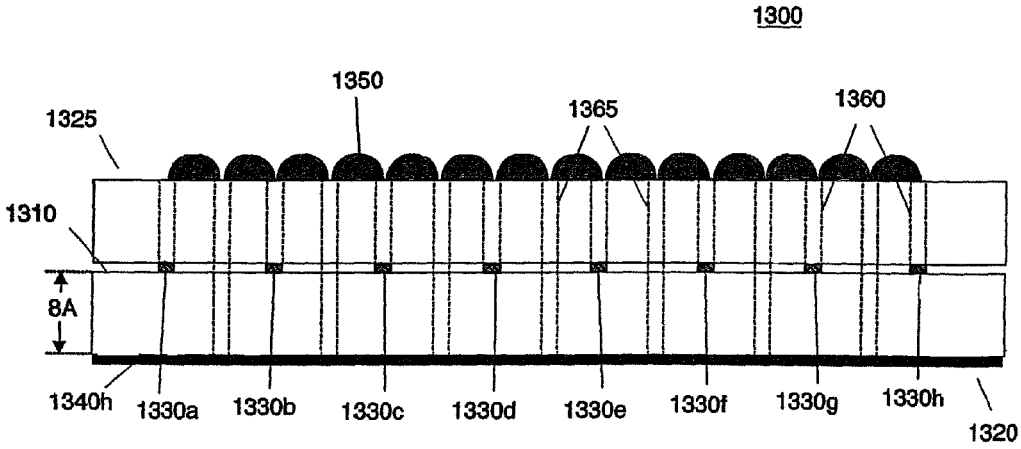

FIG. 13*a* depicts a surface view of a circuit board containing varactors on the first layer, conductors on the second and third layers and vias connecting all the layers.

Figure 13B:
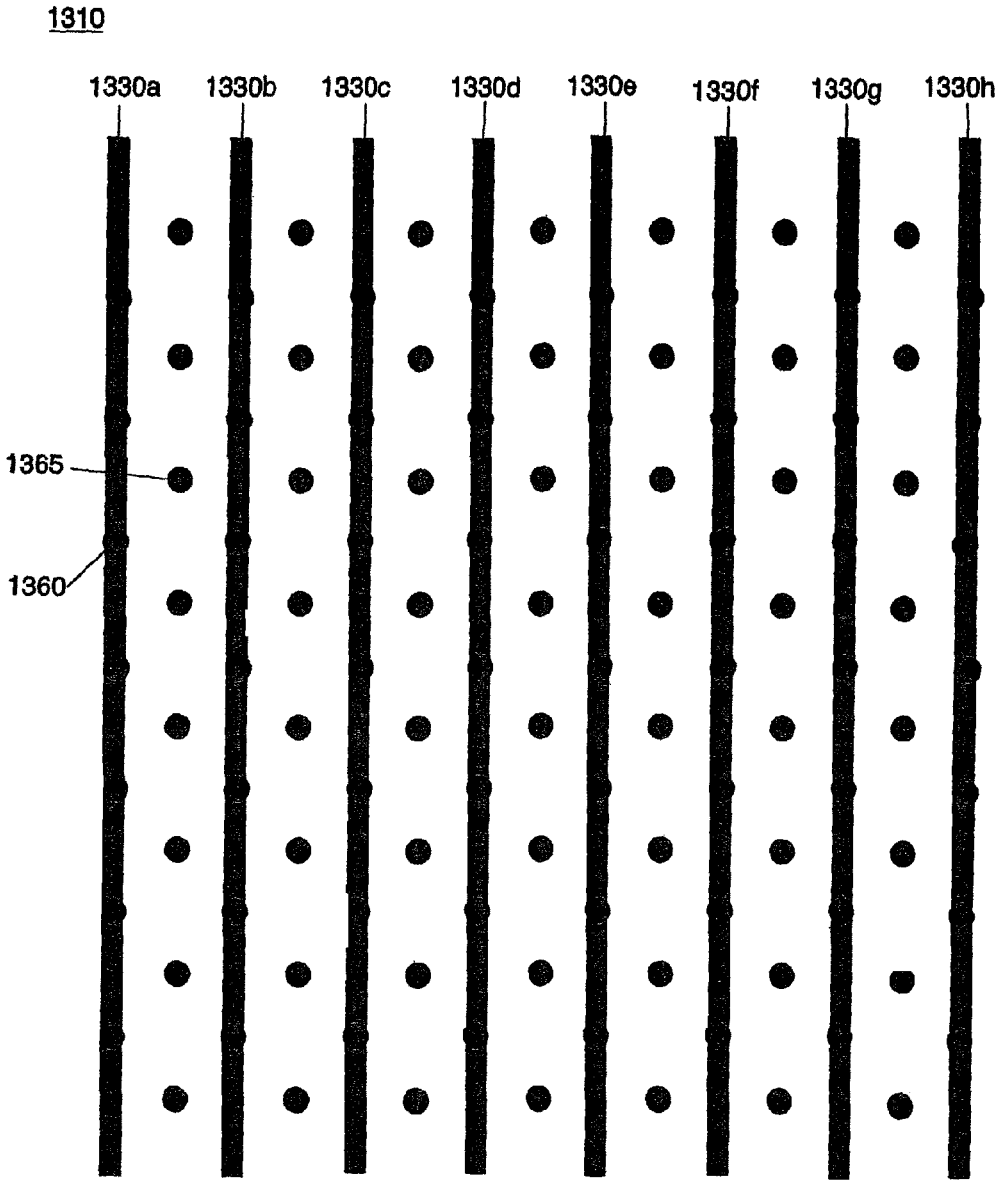
Figure 13C:
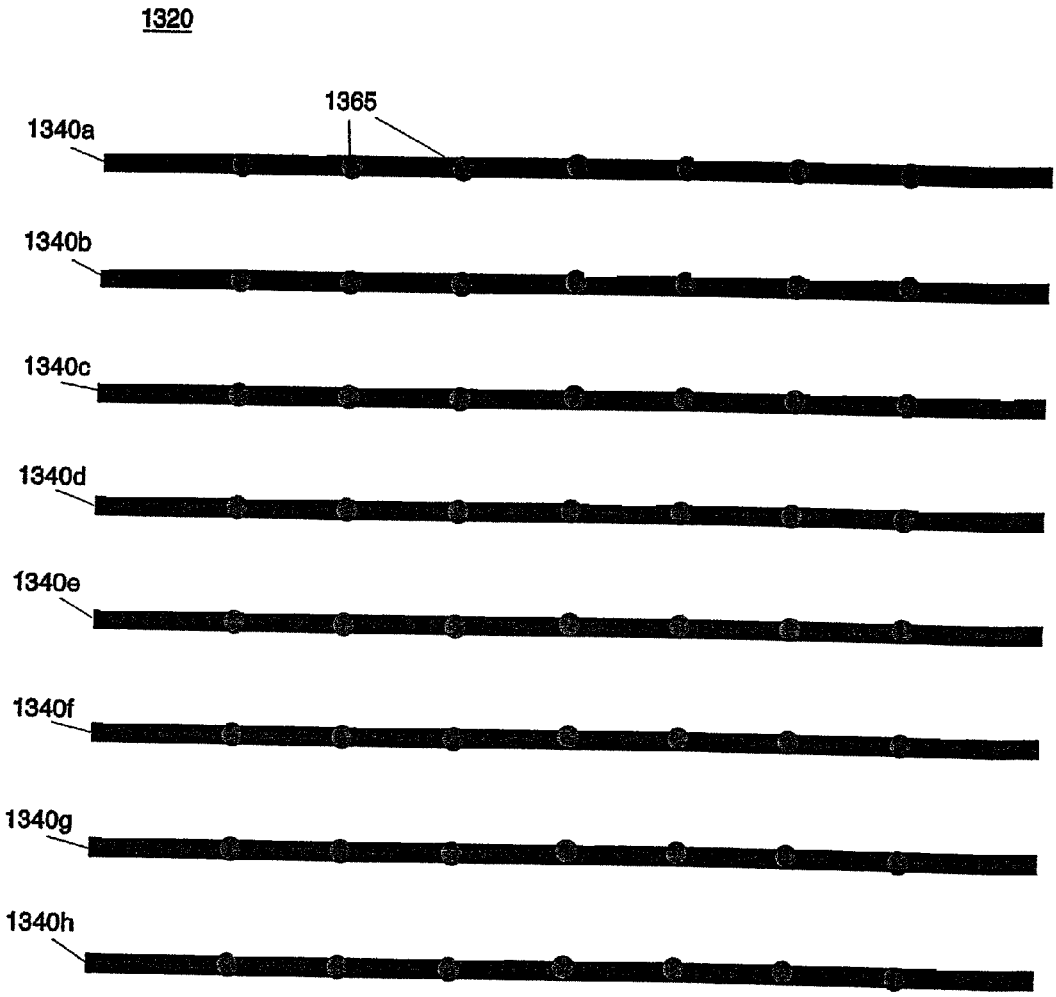
Figure 13D:
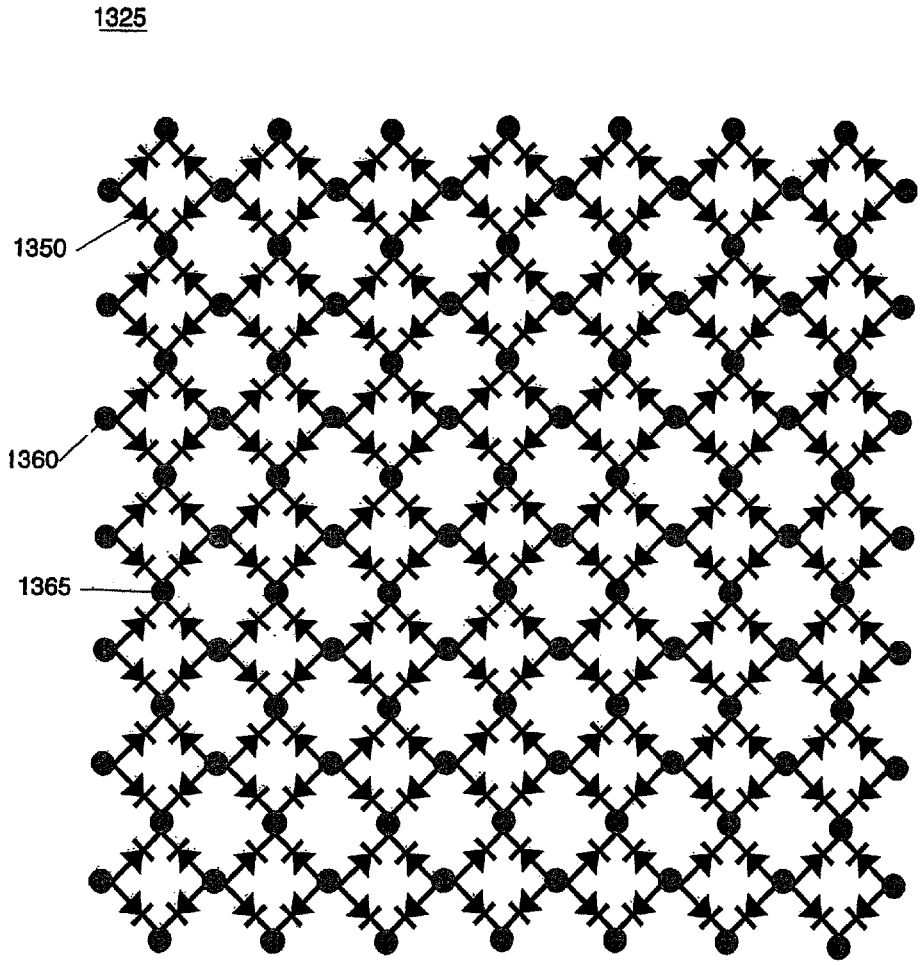

FIGS. 13*b-d* depict the front view of each layer of the circuit board in FIG. 13*a;*

Figure 13E:
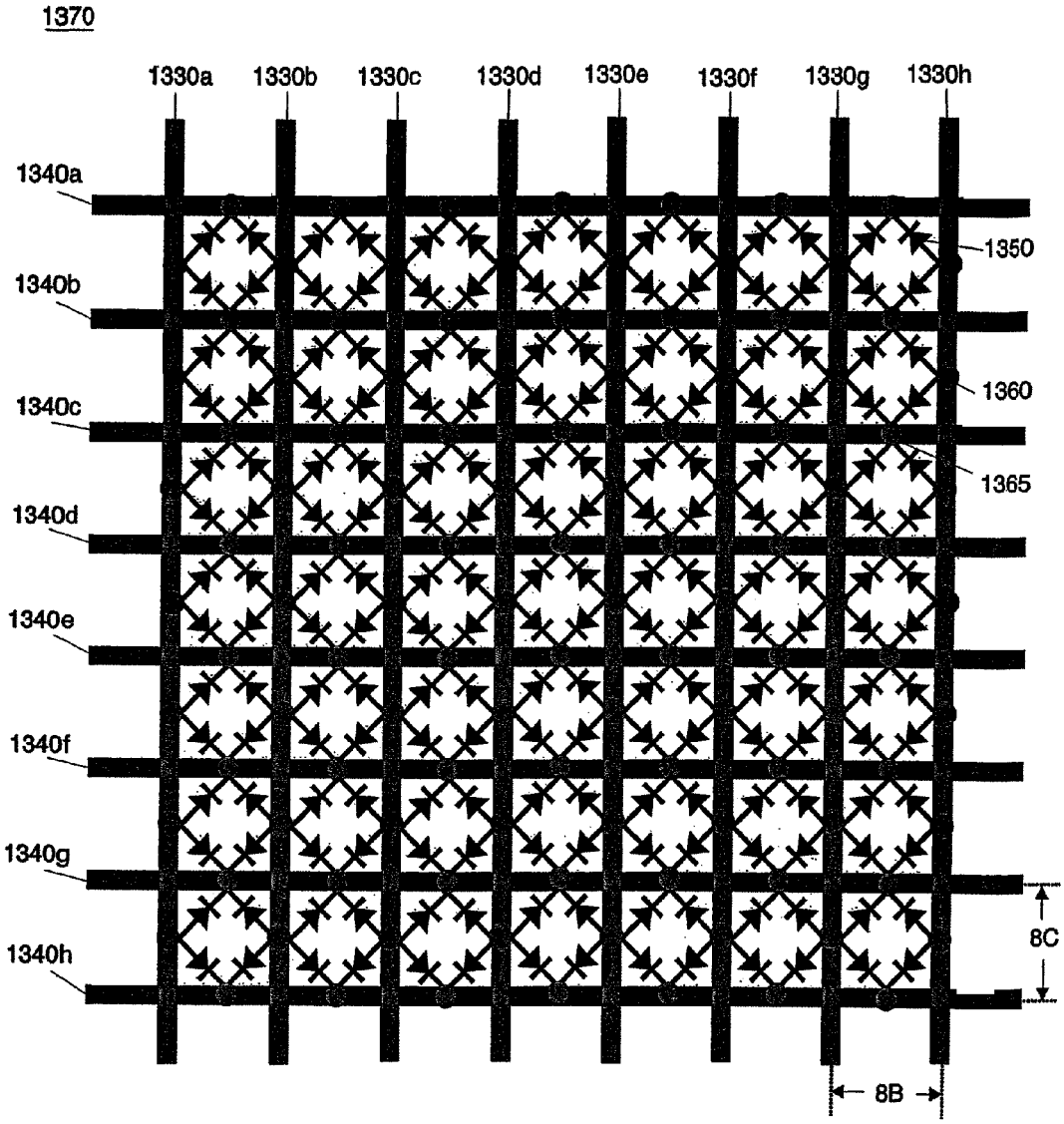

FIG. 13*e* depicts a transparent view of the first layer of the circuit board in FIG. 13*a* over the second layer of the circuit board in FIG. 13*a* over the third layer of the circuit board in FIG. 13*a;*

DETAILED DESCRIPTION

Of the two surfaces that are commonly used in FSS design, the Inverse structure 300 is the most appropriate in designing a TFSS. The series LC circuit 510, shown in FIG. 5*a*, used by the Jerusalem cross 200 is difficult to use because it lacks a continuous metal path throughout the surface, so it is difficult to provide DC bias to the internal cells. Whereas, the parallel LC circuit 511, shown in FIG. 5*b*, used by Inverse structure 300, does not have this limitation.

The parallel circuit 512, which is an equivalent circuit for LC circuit 511, can be constructed as a varactor diode 530 in parallel with a narrow metal wire 540, which acts as an inductor, and in parallel with a DC blocking capacitor 550, as shown in FIG. 5*c*.

The parallel circuit 513, which is another equivalent circuit for LC circuit 511, can also be constructed as two varactor diodes 560 and 561 in parallel with a narrow metal wire 570, which acts as an inductor, as shown in FIG. 5*d*.

Using varactor diodes has the advantage in that the opaque state is easy to achieve by simply forward-biasing the varactors, so that they are conductive. Although other kinds of varactors or equivalent devices could be presently used, such as MEMS varactors or ferroelectric varactors, for clarity's sake, this discussion will concentrate on implementing this technology using varactor diodes.

In one embodiment, the TFSS includes a circuit board 600, with an array of conductors 640*a-c*, 650*a-c* and varactors 630 on a major surface 610 and an array of conductors 670*a-c*, 680*a-c* and varactors 660 on a major surface 620, as shown in FIG. 6*a*. FIG. 6*a* shows the side view of the substrate 600.

FIG. 6*b* shows a schematic of a circuit on the major surface 610. The major surface 610 has varactors 630 organized in rows where the orientation of the varactors in one row is a mirror image of the varactors in the neighboring row, as shown in FIG. 6*b*. Conductors 640*a-c* and 650*a-c* run across the major surface 610 between the rows of varactors 630.

FIG. 6*c* shows a schematic of a circuit on the major surface 620. The surface 620 has varactors 660 organized in columns where the orientation of the varactors in one column is a mirror image of the varactors in the neighboring column, as shown in FIG. 6*c*. Conductors 670*a-c* and 680*a-c* run across the major surface 620 between the columns of varactors 660.

Although the conductors in FIGS. 6*b* and 6*c* are represented as straight lines, it shall be understood that the conductors can have different shapes, including but not limited to straight lines, crenulated lines and/or wavy lines, for this technology to work.

Although the conductors in FIGS. 6*b* and 6*c* are represented as parallel lines, it is to be understood that the conductors do not have to be perfectly parallel for this technology to work. The distance between the conductors may vary throughout the length of the conductors.

Structure 690 in FIG. 6*d* shows an overlay of the circuit on the major surface 610 and the circuit on the major surface 620. Varactors and conductors on major surface 610 are oriented at an angle to the varactors and conductors on the major surface 620. Although the varactors and conductors on the major surface 610 are depicted at a 90.degree. angle to the varactors and conductors on the major surface 620 as shown in structure 690 in FIG. 6*d*, it needs to be appreciated that the angle can be varied.

The lattice period of structure 690 is represented by distance 1B and 1C as shown in FIGS. 6*b-d*. For this technology to work the distances 1B and 1C can range from 1/15 of the wavelength to ½ of the wavelength. It needs to be appreciated that the distances 1B and 1C do not have to be equal for this technology to work.

The thickness 1A of the circuit board 600, shown in FIG. 6*a*, is sufficiently small to produce capacitive coupling between the conductors on major surface 610 and the conductors on major surface 620. Since capacitive coupling between conductors depends on the distance between the conductors and the width of the conductors, in this embodiment the width of all the conductors and thickness 1A are matched so as to produce capacitive coupling between the conductors on major surface 610 and the conductors on major surface 620.

Structure 690 was modeled using Ansoft HFSS software. See FIG. 6*e*. In the first simulation the lattice period was modeled at 1B=1C=1 cm, the conductors were modeled at 1 mm width, and substrate was modeled at 1A=1 mm thickness. The varactors were modeled as a cube of dielectric material whose dielectric constant was tuned from 1 to 64 by factors of 2. Increasing the dielectric constant from 1 to 64 tuned the resonance frequency of the surface from 8 Ghz down to about 2 Ghz. In the second simulation, the lattice period was modeled at 1B=1C=1 cm, the conductors were modeled at 1 mm width, and the substrate was modeled at 1A=7 mm thickness. The varactors were modeled as a cube of dielectric material whose dielectric constant was 8. Due to reduced capacitive coupling between conductors on the major surface 610 and the conductors on the major surface 620, the transmission level in the pass-band was reduced by about 50%, and the pass-band shifted in frequency.

Applying voltages to conductors on each major surface of the substrate controls the propagation of different frequencies through the TFSS. Depending on the voltages applied, the capacitance of the varactors is tuned and the resonance frequency of the TFSS is adjusted. Setting bias wires 640*a-c* and 670*a-c* to 0 volts and setting bias wires 650*a-c* and 680*a-c* to +10 volts, as shown in FIG. 6*f*, will cause all of the varactors to be reverse biased and this will allow a certain resonance frequency to pass through the entire TFSS. The voltage numbers are just provided as an example; a person familiar with this technology would know that the voltage numbers could be varied to achieve desired resonance frequency.

In this embodiment different regions of the TFSS can be tuned to propagate different resonance frequencies along the length of the conductors on each major surface of the circuit board 600. The propagation of the resonance frequency with horizontal polarization through the TFSS can be controlled by applying appropriate voltages to the conductors on major surface 610 as shown in FIG. 6*h*. Setting conductors 640*a-c* to 0 volts and setting conductor 650*a* to +10 volts will cause varactors in region R1 to be reverse biased and this will allow only a resonance frequency with horizontal polarization HF1 to propagate through the R1 region of TFSS between the conductors 640*a* and 640*b*, as shown in FIG. 6*g*. Setting conductor 650*b* to +15 volts will cause varactors in region R2 to be reverse biased and this will allow only a resonance frequency with horizontal polarization HF2 to propagate through the R2 region of TFSS between the conductors 640*b* and 640*c*, as shown in FIG. 6*g*. Setting conductor 650*c* to +20 volts will cause varactors in region R3 to be reverse biased and this will allow only a resonance frequency with horizontal polarization HF3 to propagate through the R3 region of TFSS between the conductors 640*c* and 650*c*, as shown in FIG. 6*g*. The voltage numbers are just provided as an example; the voltage numbers could be varied to achieve desired resonance frequency.

The propagation of the resonance frequency with vertical polarization through the TFSS can be controlled by applying appropriate voltages to the conductors on major surface 620 as shown in FIG. 6*h*. Setting conductors 670*a-c* to 0 volts and setting conductor 680*a* to +10 volts will cause varactors in region R4 to be reverse biased and this will allow only a resonance frequency with vertical polarization VF1 to propagate through the R4 region of TFSS between the conductors 670*a* and 670*b*, as shown in FIG. 6*h*. Setting conductor 680*b* to +15 volts will cause varactors in region R5 to be reverse biased and this will allow only a resonance frequency with vertical polarization VF2 to propagate through the R5 region of TFSS between the conductors 670*b* and 670*c*, as shown in FIG. 6*h*. Setting conductor 680*c* to +20 volts will cause varactors in region R6 to be reverse biased and this will allow only a resonance frequency with vertical polarization VF3 to propagate through the R6 region of TFSS between the conductors 670*c* and 670*c*, as shown in FIG. 6*h*. The voltage numbers are just provided as an example; the voltage numbers could be varied to achieve desired resonance frequency.

The propagation of the resonance frequency with horizontal and vertical polarization is achieved through structure 690 in FIG. 6*i*. When structure 690 is set up as shown in FIG. 6*i* there will be overlapping regions that will allow both a vertical and horizontal polarization of a single resonance frequency to propagate through the TFSS. Region R7, as shown in FIG. 6*i*, allows the propagation of both HF1 and VF1 through the TFSS. Region R8, as shown in FIG. 6*i*, allows the propagation of both HF2 and VF2 through the TFSS. Region R9, as shown in FIG. 6*i*, allows the propagation of both HF3 and VF3 through the TFSS. The size and shape of the regions that allow both vertical and horizontal polarization resonance frequencies to propagate through TFSS shown here are just provided as an example. The size and shape of these regions can be adjusted by applying appropriate voltages to the appropriate conductors.

When structure 690 is set up as shown in FIG. 6*i*, there will also be overlapping regions that will allow both a vertical and horizontal polarization of different resonance frequencies to propagate through the TFSS. Region R10, as shown in FIG. 6*i*, allows the propagation of BF1 and VF2 through the TFSS. Region R11, as shown in FIG. 6*i*, allows the propagation of HF1 and VF3 through the TFSS. Region R12, as shown in FIG. 6*i*, allows the propagation of HF2 and VF1 through the TFSS. Region R13, as shown in FIG. 6*i*, allows the propagation of HF3 and VF1 through the TFSS. Region R14, as shown in FIG. 6*i*, allows the propagation of HF3 and VF2 through the TFSS. Region R15, as shown in FIG. 6*i*, allows the propagation of HF2 and VF3 through the TFSS.

In this embodiment, the TFSS can also be set to an opaque (off) state. The opaque state is achieved by forward biasing the varactors, as shown in FIG. 6*j*, which shorts across the continuously conductive loop. Setting conductors 640*a-c* and 670*a-c* to 0 volts and setting conductors 650*a-c* and 680*a-c* to −1 volts, as shown in FIG. 6*j*, will cause all of the varactors to be forward biased thereby blocking all the resonance frequencies from propagating though the TFSS. The voltage numbers are just provided as an example; the voltage numbers could be varied and still cause all of the varactors to be forward biased.

In this embodiment, the region of the TFSS can be set to an opaque state while the remaining region is set to propagate a certain resonance frequency. The propagation of a particular resonance frequency with horizontal polarization through a region of the TFSS and blocking the remaining resonance frequencies with horizontal polarization through the rest of the TFSS can be controlled by applying appropriate voltages to the conductors on major surface 610 as shown in FIG. 6*k*. Setting conductors 640*a-c* to 0 volts and setting conductors 650*a* and 650*c* to −1 volts will cause varactors in regions R16 and R18 to be forward biased and this will block any resonance frequency with horizontal polarization from propagating through the R16 and R18 regions of TFSS, as shown in FIG. 6*k* Setting conductors 650*b* to +15 volts will cause varactors in region R17 to be reverse biased and this will allow a resonance frequency with horizontal polarization HF2 to propagate through the R17 region of TFSS, as shown in FIG. 6*k*. The voltage numbers are just provided as an example. The voltage numbers could be varied to achieve desired resonance frequency or an opaque state.

The propagation of a particular resonance frequency with vertical polarization through a region of the TFSS and blocking the remaining resonance frequencies with vertical polarization through the rest of the TFSS can be controlled by applying appropriate voltages to the conductors on major surface 620 as shown in FIG. 6*l*. Setting conductors 670*a-c* to 0 volts and setting conductors 680*a* and 680*c* to −1 volts will cause varactors in the regions R19 and R21 to be forward biased and this will block any resonance frequency with vertical polarization from propagating through the R19 and R21 regions of TFSS, as shown in FIG. 6*l*. Setting conductor 680*b* to +15 volts will cause varactors in the region R20 to be reverse biased and this will allow a resonance frequency with vertical polarization VF2 to pass through the R20 region of TFSS, as shown in FIG. 6*l*. The voltage numbers are just provided as an example, the voltage numbers could be varied to achieve desired resonance frequency or an opaque state.

The propagation of a particular resonance frequency with horizontal and vertical polarization through a region of the TFSS and blocking of the remaining resonance frequencies through the rest of the TFSS is achieved through the structure 690 in FIG. 6*m*. When structure 690 is set up as shown in FIG. 6*m* there will be a region propagating a particular resonance frequency, regions with horizontal and vertical polarization, regions blocking all the frequencies, regions propagating only horizontal polarization of the particular frequency and regions propagating only vertical polarization of the particular resonance frequency. Region R30, as shown in FIG. 6*m*, allows the propagation of HF2 and VH2 through the TFSS. Regions R22, R29, R27 and R25 as shown in FIG. 6*m*, block all the vertical and horizontal polarizations of all the resonance frequencies from propagating through the TFSS. Regions R26 and R23 allow propagation of only VF2 through the TFSS. Regions R28 and R24 allow propagation of only HF2 through the TFSS. The size and shape of the region that allows both vertical and horizontal polarization resonance frequencies to pass through TFSS shown here are just provided as an example. The size and shape of these regions can be adjusted by applying an appropriate voltage to the appropriate conductors. The size and shape of the opaque regions shown here are also just provided as an example. The size and shape of these opaque regions can be adjusted by applying an appropriate voltage to the appropriate conductors.

In another embodiment, the TFSS includes a circuit board 700, with an array of conductors 740*a-d*, 730*a-d* and varactors 750 on the major surface 710, an array of conductors 160*a-c*, 770*a-c* and varactors 780 on the major surface 720 and vias 795 and 796 connecting major surfaces 710 and 720 as shown in FIG. 7*a-c*. FIG. 7*a* shows the side view of the substrate 700.

FIG. 7*b* shows a schematic of a circuit on the major surface 710. The major surface 710 has a plurality of oppositely oriented varactors 750 connected in series and organized in rows where the orientation of the varactors in one row is a mirror image of the varactors in the neighboring row, as shown in FIG. 7*b*. Conductors 740*a-d* run along the length of the major surface 710 between the rows of varactors 750. Conductors 730*a-d* run along the width of the major surface 710 between the varactors 750 connecting the conductors 740*a-d*, as shown. in FIG. 7*b*.

FIG. 7*c* shows a schematic of a circuit on the major surface 720. The major surface 720 has a plurality of oppositely oriented varactors 780 connected in series and organized in columns where the orientation of the varactors in one column is a mirror image of the varactors in the neighboring column, as shown in FIG. 7*c*. Conductors 760*a-c* run along the width of the major surface 720 between the columns of varactors 780. Conductors 770*a-c* run along the length of the major surface 720 between the varactors 780 connecting the conductors 760*a-c*, as shown in FIG. 7*c*.

Although the conductors in FIGS. 7*b* and 7*c* are represented as straight lines, it is to be understood that the conductors can have different shapes, including but not limited to straight lines, crenulated lines and/or wavy lines, for this technology to work.

Although the conductors in FIGS. 7*b* and 7*c* are represented as parallel lines, it is to be understood that the conductors do not have to be perfectly parallel for this technology to work. The distance between the conductors may vary throughout the length of the conductors.

Although conductors 730*a-d* appear to be perpendicular to conductors 740*a-d* in FIG. 7*b*, it is to be understood that these conductors do not have to be perfectly perpendicular for this technology to work. The angle between the intersecting conductors may vary.

Although conductors 760*a-c* appear to be perpendicular to conductors 770*a-c* in FIG. 7*c* it is to be understood that these conductors do not have to be perfectly perpendicular for this technology to work. The angle between the intersecting conductors may vary.

Structure 790 in FIG. 7*d* shows an overlay of the circuit on the major surface 710 and the circuit on the major surface 720. Varactors and conductors on major surface 710 are oriented at an angle to the varactors and conductors on the major surface 720. Although the varactors and conductors on the major surface 710 are depicted at a 90.degree. angle to the varactors and conductors on the major surface 720 as shown in structure 790 in FIG. 7*d*, it needs to be appreciated that the angle can be varied.

Vias 796 connect the varactors 780 on the major surface 720 to conductors 730*a-d* on the major surface 710, shown in FIG. 7*d*. Vias 795 connect the varactors 750 on the major surface 710 to conductors 770*a-c* on the major surface 720, shown in FIG. 7*d*.

The lattice period of structure 790 is represented by distance 2B and 2C as shown in FIG. 7*d*. For this technology to work, the distances 2B and 2C can range from 1/15 of the wavelength to ½ of the wavelength. The distances 2B and 2C do not have to be equal for this technology to work.

The thickness 2A of the circuit board 700, shown in FIG. 7*a*, is less important than the thickness 1A of the circuit board 600 described above. Vias 796 and 795 make the circuit board 700 less susceptible to the variations in the thickness 2A.

Structure 790 was modeled using Ansoft HFSS software. See FIG. 7*e*. In the first simulation the lattice period was modeled at 2B=2C=1 cm, the conductors were modeled at 1 mm width, and the substrate was modeled at 2A=1 mm thickness. The varactors were modeled as a cube of dielectric material whose dielectric constant was tuned from 1 to 64 by factors of 2. Increasing the dielectric constant from 1 to 64 tuned the resonance frequency of the surface from 8 Ghz down to about 2 Ghz. In the second simulation the lattice period was modeled at 2B=2C=1 cm, the conductors were modeled at 1 mm width, and the substrate was modeled at 2A=7 mm thickness. The varactors were modeled as a cube of dielectric material whose dielectric constant was 8. As can be seen by the results, shown in FIG. 7*e*, this design is more resistant to variations in the substrate thickness. The transmission level in the pass-band was reduced by about 20%. This design is less concerned with maintaining capacitive coupling and is more resistant to variations in the thickness 2A.

Applying voltages to conductors on each major surface of the substrate controls the propagation of different frequencies through the TFSS. Depending on the voltages applied, the capacitance of the varactors is tuned and the resonance frequency of the TFSS is adjusted. Setting conductors on the major surface 710 to 0 volts and setting conductors on the major surface 720 to +10 volts, as shown in FIG. 7*f*, will cause all of the varactors to be reverse biased and this will allow a certain resonance frequency to pass through the entire TFSS. The voltage numbers are just provided as an example; the voltage numbers could be varied to achieve desired resonance frequency.

In this embodiment, the TFSS can also be set into an opaque (off) state. The opaque state is achieved by forward biasing the varactors, as shown in FIG. 7*g*, which shorts across the continuously conductive loop. Setting conductors on major surface 710 to 0 volts and setting conductors on major surface 720 to −1 volts, as shown in FIG. 7*g*, will cause all of the varactors to be forward biased, thereby blocking all the resonance frequencies from propagating through the TFSS. The voltage numbers are just provided as an example; the voltage numbers could be varied and still cause all of the varactors to be forward biased.

In another embodiment, the TFSS includes a circuit board 800, with an array of conductors 840*a-d*, 830*a-d* and varactors 880 on the major surface 810, an array of conductors 860*a-c*, 870*a-c* on the major surface 820 and vias 895 connecting major surfaces 810 and 820 as shown in FIG. 8*a-c*. FIG. 8*a* shows the side view of the substrate 800.

FIG. 8*b* shows a schematic of a circuit on the major surface 810. The major surface 810 has a plurality of oppositely oriented, interconnected varactors 880 organized in rows where the orientation of the varactors in one row is a mirror image of the varactors in the neighboring row, as shown in FIG. 8*b*. Conductors 840*a-d* run along the length of the major surface 810 between the rows of varactors 880. Conductors 830*a-d* run along the width of the major surface 810 between the varactors 880 connecting the conductors 840*a-d*, as shown in FIG. 8*b*.

FIG. 8*c* shows a schematic of a circuit on the major surface 820. The major surface 820 has conductors 860*a-c* running along the width of the major surface 820 and conductors 870*a-c* running along the length of the major surface 820 connecting the conductors 860*a-c*, as shown in FIG. 8*c*.

Although the conductors in FIGS. 8*b* and 8*c* are represented as straight lines, it is to be understood that the conductors can have different shapes, including but not limited to straight lines, crenulated lines and/or wavy lines, for this technology to work.

Although the conductors in FIGS. 8*b* and 8*c* are represented as parallel lines, it is to be understood that the conductors do not have to be perfectly parallel for this technology to work. The distance between the conductors may vary throughout the length of the conductors.

Although conductors 830*a-d* appear to be perpendicular to conductors 840*a-d* in FIG. 8*b*, it is to be understood that these conductors do not have to be perfectly perpendicular for this technology to work. The angle between the intersecting conductors may vary.

Although conductors 860*a-c* appear to be perpendicular to conductors 870*a-c* in FIG. 8*c*, it is to be understood that these conductors do not have to be perfectly perpendicular for this technology to work. The angle between the intersecting conductors may vary. Structure 890 in FIG. 8*d* shows an overlay of the circuit on the major surface 810 and the circuit on the major surface 820. Conductors on major surface 810 are oriented at an angle to the conductors on the major surface 820. Although the conductors on the major surface 810 are depicted at a 90.degree. angle to the conductors on the major surface 820 as shown in structure 890 in FIG. 8*d*, it needs to be appreciated that the angle can be varied.

Vias 895 connect the varactors 880 on the major surface 810 to the point of intersection of conductors 870*a-c* and 860*a-c* on the major surface 820, shown in FIG. 8*d*.

The lattice period of structure 890 is represented by distance 3B and 3C as shown in FIG. 8*d*. For this technology to work, the distances 3B and 3C can range from 1/15 of the wavelength to ½ of the wavelength. The distances 3B and 3C do not have to be equal for this technology to work.

The thickness 3A of the circuit board 800, shown in FIG. 8*a*, is less important than the thickness 1A of the circuit board 600 described above. Vias 895 make the circuit board 800 less susceptible to the variations in the thickness 3A.

Structure 890 was modeled using Ansoft HFSS software. See FIG. 8*e*. In the first simulation, the lattice period was modeled at 3B=3C=1 cm, the conductors were modeled at 1 mm width, and the substrate was modeled at 3A=1 mm thickness. The varactors were modeled as a cube of dielectric material whose dielectric constant was tuned from 1 to 64 by factors of 2. Increasing the dielectric constant from 1 to 64 tuned the resonance frequency of the surface from 8 Ghz down to about 2 Ghz. In the second simulation, the lattice period was modeled at 3B=3C=1 cm thickness, the conductors were modeled at 1 mm width, and the substrate was modeled at 3A=7 mm thickness. The varactors were modeled as a cube of dielectric material whose dielectric constant was tuned from 1 to 64 by factors of 2. As can be seen by the results, shown in FIG. 8*e*, this design is more resistant to variations in the substrate thickness and requires less varactors which offers simpler construction.

Applying voltages to conductors on each major surface of the substrate controls the propagation of different frequencies through the TFSS. Depending on the voltages applied, the capacitance of the varactors is tuned and the resonance frequency of the TFSS is adjusted. Setting conductors on the major surface 810 to 0 volts and setting conductors on the major surface 820 to +10 volts, as shown in FIG. 8*f*, will cause all of the varactors to be reverse biased and this will allow a certain resonance frequency to pass through the entire TFSS. The voltage numbers are just provided as an example; the voltage numbers could be varied to achieve desired resonance frequency.

In this embodiment, the TFSS can be set into an opaque (off) state. The opaque state is achieved by forward biasing the varactors, as shown in FIG. 8*g*, which shorts across the continuously conductive loop. Setting conductors on major surface 810 to 0 volts and setting conductors on major surface 820 to −1 volts, as shown in FIG. 8*g*, will cause all of the varactors to be forward biased thereby blocking all the resonance frequencies from propagating though the TFSS. The voltage numbers are just provided as an example; the voltage numbers could be varied and still cause all of the varactors to be forward biased.

It should be apparent that this embodiment could be implemented in other ways.

For example, the TFSS includes a circuit board 900, with an array of conductors 940*a-d*, 930*a-d* on the major surface 910, an array of conductors 960*a-c*, 970*a-c*, varactors 980 on the major surface 920 and vias 995 connecting major sides 910 and 920 as shown in FIG. 9*a-c*. FIG. 9*a* shows the side view of the substrate 900.

FIG. 9*b* shows a schematic of a circuit on the major surface 910. The major surface 910 has conductors 930*a-d* running along the width of the major surface 910 and conductors 940*a-d* running along the length of the major surface 910 connecting the conductors 930*a-d*, as shown in FIG. 9*b*.

FIG. 9*c* shows a schematic of a circuit on the major surface 920. The major surface 920 has a plurality of oppositely oriented, interconnected varactors 980 organized in rows where the orientation of the varactors in one row is a mirror image of the varactors in the neighboring row, as shown in FIG. 9*c*. Conductors 970*a-c* run along the length of the major surface 920 between the rows of varactors 980. Conductors 960*a-c* run along the width of the major surface 920 between the varactors 980 connecting the conductors 970*a-c*, as shown in FIG. 9*c*.

Although the conductors in FIGS. 9*b* and 9*c* are represented as straight lines, it is to be understood that the conductors can have different shapes, including but not limited to straight lines, crenulated lines and/or wavy lines, for this technology to work.

Although the conductors in FIGS. 9*b* and 9*c* are represented as parallel lines, it is to be understood that the conductors do not have to be perfectly parallel for this technology to work. The distance between the conductors may vary throughout the length of the conductors.

Although conductors 930*a-d* appear to be perpendicular to conductors 940*a-d* in FIG. 9*b* it is to be understood that these conductors do not have to be perfectly perpendicular for this technology to work. The angle between the intersecting conductors may vary.

Although conductors 960*a-c* appear to be perpendicular to conductors 970*a-c* in FIG. 9*c* it is to be understood that these conductors do not have to be perfectly perpendicular for this technology to work. The angle between the intersecting conductors may vary.

Structure 990 in FIG. 9*d* shows an overlay of the circuit on the major surface 910 and the circuit on the major surface 920. Conductors on major surface 910 are oriented at an angle to the conductors on the major surface 920. Although the conductors on the major surface 910 are depicted at a 90.degree. angle to the conductors on the major surface 920 as shown in structure 990 in FIG. 9*d*, it needs to be appreciated that the angle can be varied.

Vias 995 connect the varactors 980 on the major surface 920 to the point of intersection of conductors 930*a-d* and 940*a-d* on the major surface 910, shown in FIG. 9*d*.

In another example, the TFSS includes a circuit board 1000, with an array of conductors 1040*a-d*, 1030*a-d* on the major surface 1010, an array of conductors 1060*a-c*, 1070*a-c* on the major surface 1020, varactors 1080 on the major surface 1025 and vias 1095 and 1096 connecting major sides 1010, 1025 and 1020 as shown in FIG. 10*a-d*. FIG. 10*a* shows the side view of the substrate 1000.

FIG. 10*b* shows a schematic of a circuit on the major surface 1010. The major surface 1010 has conductors 1030*a-d* running along the width of the major surface 1010 and conductors 1040*a-d* running along the length of the major surface 1010 connecting the conductors 1030*a-d*, as shown in FIG. 10*b*.

FIG. 10*c* shows a schematic of a circuit on the major surface 1020. The major surface 1020 has conductors 1070*a-c* running along the length of the major surface 1020 and conductors 1060*a-c* running along the width of the major surface 1020 connecting the conductors 1070*a-c*, as shown in FIG. 10*c*.

FIG. 10*d* shows a schematic of a circuit on the major surface 1025. The major surface 1025 has a plurality of oppositely oriented, interconnected varactors 1080, as shown in FIG. 10*d*.

Vias 1095 connect the varactors 1080 on the major surface 1025 to the point of intersection of conductors 1030*a-d* and 1040*a-d* on the major surface 1010, shown in FIG. 10*e*.

Vias 1096 connect the varactors 1080 on the major surface 1025 to the point of intersection of conductors 1070*a-c* and 1060*a-c* on the major surface 1020, shown in FIG. 10*e*.

Although the conductors in FIGS. 10*b* and 10*c* are represented as straight lines, it is to be understood that the conductors can have different shapes, including but not limited to straight lines, crenulated lines and/or wavy lines, for this technology to work.

Although the conductors in FIGS. 10*b* and 10*c* are represented as parallel lines, it is to be understood that the conductors do not have to be perfectly parallel for this technology to work. The distance between the conductors may vary throughout the length of the conductors.

Although conductors 1030*a-d* appear to be perpendicular to conductors 1040*a-d* in FIG. 10*b* it is to be understood that these conductors do not have to be perfectly perpendicular for this technology to work. The angle between the intersecting conductors may vary.

Although conductors 1060*a-c* appear to be perpendicular to conductors 1070*a-c* in FIG. 10*c* it is to be understood that these conductors do not have to be perfectly perpendicular for this technology to work. The angle between the intersecting conductors may vary.

Structure 1090 in FIG. 10*e* shows an overlay of the circuit on the major surface 1010, the circuit on the major surface 1025 and the circuit on the major surface 1020. Conductors on major surface 1010 are oriented at an angle to the conductors on the major surface 1020. Although the conductors on the major surface 1010 are depicted at a 90.degree. angle to the conductors on the major surface 1020 as shown in structure 1090 in FIG. 10*e*, it needs to be appreciated that the angle can be varied.

These are just some of the examples of implementing this embodiment; there are other implementations available although not specifically listed here.

In another embodiment, the TFSS includes a circuit board 1100, with an array of conductors 1130*a-h* and varactors 1150 on the major surface 1110, an array of conductors 1140*a-h* on the major surface 1120 and vias 1160 connecting major sides 1110 and 1120 as shown as shown in FIG. 1*a-c*. FIG. 11*a* shows the side view of the substrate 1100.

FIG. 11*b* shows a schematic of a circuit on the major surface 1110. The major surface 1110 has a plurality of oppositely oriented, interconnected varactors 1150 organized in columns where the orientation of the varactors in one column is a mirror image of the varactors in the neighboring column, as shown in FIG. 11*b*. Conductors 1130*a-h* run along the width of the major surface 1110 between the columns of varactors 1150, as shown in FIG. 11*b*.

FIG. 11*c* shows a schematic of a circuit on the major surface 1120. The surface 1120 has conductors 1140*a-h* running across the length surface 1120, as shown in FIG. 11*c*.

Although the conductors in FIGS. 11*b* and 11*c* are represented as straight lines, it is to be understood that the conductors can have different shapes, including but not limited to straight lines, crenulated lines and/or wavy lines, for this technology to work.

Although the conductors in FIGS. 11*b* and 11*c* are represented as parallel lines, it is to be understood that the conductors do not have to be perfectly parallel for this technology to work. The distance between the conductors may vary throughout the length of the conductors.

Structure 1170 in FIG. 11*d* shows an overlay of the circuit on the major surface 1110 and the circuit on the major surface 1120. Conductors on major surface 1110 are oriented at an angle to the conductors on the major surface 1120. Although the conductors on the major surface 1110 are depicted at a 90.degree. angle to the conductors on the major surface 1120 as shown in structure 1170 in FIG. 11*d*, it needs to be appreciated that the angle can be varied.

Vias 1160 connect the varactors 1150 on the major surface 1110 to conductors on the major surface 1120, shown in FIG. 11*d*.

The lattice period of structure 1170 is represented by distance 6B and 6C as shown in FIG. 11*d*. For this technology to work, the distances 6B and 6C can range from 1/15 of the wavelength to ½ of the wavelength. It needs to be appreciated that the distances 6B and 6C do not have to be equal for this technology to work.

The thickness 6A of the circuit board 1100, shown in FIG. 11*a*, is sufficiently small to produce capacitive coupling between the conductors on major surface 1110 and the conductors on major surface 1120. The capacitive coupling between conductors depends on the distance between the conductors and the width of the conductors. In this embodiment, the width of all the conductors and thickness 6A are matched so as to produce capacitive coupling between the conductors on major surface 1110 and the conductors on major surface 1120.

Structure 1170 was modeled using Ansoft HFSS software. See FIG. 11*e*. In the first simulation, the lattice period was set at 6B=6C=1 cm, the conductors were modeled at 1 mm width, and the substrate was modeled at 6A=1 mm thickness. The varactors were modeled as a cube of dielectric material whose dielectric constant was tuned from 1 to 64 by factors of 2. Increasing the dielectric constant from 1 to 64 tuned the resonance frequency of the surface from 8 Ghz down to about 2 Ghz. In the second simulation, the lattice period was modeled at 6B=6C=1 cm, the conductors were modeled at 1 mm width, and the substrate was modeled at 6A=7 mm thickness. The varactors were modeled as a cube of dielectric material whose dielectric constant was 8. As can be seen by the results, shown in FIG. 11*e*, this design is more resistant to variations in the substrate thickness. There was only minor degradation of transmission magnitude as the substrate thickness was increased.

Applying voltages to conductors on each major surface of the substrate controls the propagation of different frequencies through the TFSS. Depending on the voltages applied, the capacitance of the varactors is tuned and the resonance frequency of the TFSS is adjusted. Setting bias wires 1130*a-h* to 0 volts and setting bias wires 1140*a-h* to +10 volts, as shown in FIG. 11*f*, will cause all of the varactors to be reverse biased and this will allow a certain resonance frequency to pass through the entire TFSS. The voltage numbers are just provided as an example; the voltage numbers could be varied to achieve desired resonance frequency.

In this embodiment the TFSS can be set into an opaque (off) state. The opaque state is achieved by forward biasing the varactors, as shown in FIG. 11*g*, which shorts across the continuously conductive loop. Setting conductors 1130*a-h* to 0 volts and setting conductors 650*a-c* and 680*a-c* to −1 volts, as shown in FIG. 11*g*, will cause all of the varactors to be forward biased, thereby blocking all the resonance frequencies from propagating though the TFSS. The voltage numbers are just provided as an example; the voltage numbers could be varied and still cause all of the varactors to be forward biased.

In this embodiment, different regions of the TFSS can also be tuned to propagate different resonance frequencies and be set to an opaque state. Setting conductors 1130*d-e* to 0 volts and setting conductors 1140*d-e* to +10 volts will cause varactors in region R39 to be reverse biased and this will allow a resonance frequency with horizontal and vertical polarization HVF4 to propagate through the R39 region of TFSS, as shown in FIG. 11*g*. Setting conductors 1130*a-c* and 1130*f-h* to +5.5 volts and conductors 1140*a-c* and 1140*f-h* to 4.5 volts will cause varactors in region R31, R33, R35 and R37 to be forward biased, thereby blocking the propagation of all horizontal and vertical resonance frequencies through the R31, R33, R35 and R37 regions of TFSS, as shown in FIG. 6*g*. As a by-product, varactors in the regions R32 and R36 are also reverse biased and this will allow a resonance frequency with horizontal and vertical polarization HVF5 to propagate through the R32 and R36 region of TFSS, as shown in FIG. 11*g*. Varactors in the regions R38 and R34 are also reverse biased and this will allow a resonance frequency with horizontal and vertical polarization HVF6 to propagate through the R38 and R34 region of TFSS, as shown in FIG. 11*g*. The voltage numbers are just provided as an example. A person familiar with this technology would know that the voltage numbers could be varied to achieve any desired resonance frequency. The size and shape of the regions that allow the resonance frequencies to propagate or not propagate through TFSS shown here are just provided as an example. The size and shape of these regions can be adjusted by applying appropriate voltages to the appropriate conductors.

It should be apparent that this embodiment could be implemented in other ways.

For example, the TFSS includes a circuit board 1200, with an array of conductors 1230*a-h* on the major surface 1210, an array of conductors 1240*a-h* and varactors 980 on the major surface 1220, and vias 1260 connecting major sides 1210 and 1220 as shown in FIG. 12*a-c*. FIG. 12*a* shows the side view of the substrate 1200.

FIG. 12*b* shows a schematic of a circuit on the major surface 1210. The major surface 1210 has conductors 1230*a-h* running along the width of the major surface 1210, as shown in FIG. 9*b*.

FIG. 12*c* shows a schematic of a circuit on the major surface 1220. The major surface 1220 has a plurality of oppositely oriented, interconnected varactors 1250 organized in rows where the orientation of the varactors in one row is a mirror image of the varactors in the neighboring row, as shown in FIG. 12*c*. Conductors 1240*a-h* run along the length of the major surface 1220 between the rows of varactors 1250, as shown in FIG. 12*c*.

Although the conductors in FIGS. 12*b* and 12*c* are represented as straight lines, it is to be understood that the conductors can have different shapes, including but not limited to straight lines, crenulated lines and/or wavy lines, for this technology to work.

Although the conductors in FIGS. 12*b* and 12*c* are represented as parallel lines, it is to be understood that the conductors do not have to be perfectly parallel for this technology to work. The distance between the conductors may vary throughout the length of the conductors.

Structure 1270 in FIG. 12*d* shows an overlay of the circuit on the major surface 1210 and the circuit on the major surface 1220. Conductors on major surface 1210 are oriented at an angle to the conductors on the major surface 1220. Although the conductors on the major surface 1210 are depicted at a 90.degree. angle to the conductors on the major surface 1220, as shown in structure 1270 in FIG. 12*d*, it needs to be appreciated that the angle can be varied.

Vias 1260 connect the varactors 1250 on the major surface 1220 to conductors on the major surface 1210, shown in FIG. 12*d*.

In another example, the TFSS includes a circuit board 1300, with an array of conductors 1330*a-h* on the major surface 1310, an array of conductors 1340*a-h* on the major surface 1320, varactors 1350 on the major surface 1325, and vias 1360 and 1365 connecting major sides 1310, 1325 and 1320 as shown in FIG. 13*a-d*. FIG. 13*a* shows the side view of the substrate 1000.

FIG. 13*b* shows a schematic of a circuit on the major surface 1310. The major surface 1310 has conductors 1330*a-h* running along the width of the major surface 1310, as shown in FIG. 13*b*.

FIG. 13*c* shows a schematic of a circuit on the major surface 1320. The major surface 1320 has conductors 1340*a-h* running along the length of the major surface 1320, as shown in FIG. 13*c*.

FIG. 13*d* shows a schematic of a circuit on the major surface 1325. The major surface 1325 has a plurality of oppositely oriented, interconnected varactors 1350, as shown in FIG. 13*d*.

Vias 1360 connect the varactors 1350 on the major surface 1025 to the conductors 1330*a-h* on the major surface 1310, shown in FIG. 13*e*.

Vias 1365 connect the varactors 1500 on the major surface 1025 to the conductors 1340*a-h* on the major surface 1320, shown in FIG. 13*e*.

Although the conductors in FIGS. 13*b* and 13*c* are represented as straight lines, it is to be understood that the conductors can have different shapes, including but not limited to straight lines, crenulated lines and/or wavy lines, for this technology to work.

Although the conductors in FIGS. 13*b* and 13*c* are represented as parallel lines, it is to be understood that the conductors do not have to be perfectly parallel for this technology to work. The distance between the conductors may vary throughout the length of the conductors.

Structure 1370 in FIG. 13*d* shows an overlay of the circuit on the major surface 1310, the circuit on the major surface 1325, and the circuit on the major surface 1320. Conductors on major surface 1310 are oriented at an angle to the conductors on the major surface 1320. Although the conductors on the major surface 1310 are depicted at a 90.degree. angle to the conductors on the major surface 1320, as shown in structure 1370, in FIG. 13*d*, it needs to be appreciated that the angle can be varied.

These are just some of the examples of implementing this embodiment; there are other implementations available although not specifically listed here.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

What is claimed is:

1. A method of achieving an opaque or absorptive state in at least a region of a tunable frequency selective surface, the method comprising:

applying a plurality of voltages to elongated conductors disposed on a first major surface and on a second major surface of the tunable frequency selective surface, at least some of the plurality of elongated conductors on the first major surface each crossing over at least some of the plurality of elongated conductors on the second major surface, the plurality of voltages causing a plurality of varactors coupling neighboring elongated conductors disposed on said first and/or second major surfaces to be forward-biased and to cause the at least a region of the tunable frequency selective surface to be in the opaque or absorptive state.

2. The method of claim 1 wherein first selected ones of said varactors couple neighboring elongated conductors on said first major surface and second selected ones of said varactors couple neighboring elongated conductors on said second major surface and wherein each one of said first selected ones of said varactors overlies a one of said second selected ones of said varactors.

3. A method of tuning at least a region of a tunable frequency selective surface so that at least one region thereof is placed in an opaque or absorptive state, the method comprising:

disposing a plurality of conductors on first and second major surfaces of the tunable frequency selective surface, wherein each conductor on the first surface is arranged to run along one length of the tunable frequency selective surface and each conductor on the second surface is arranged to run along another length of the tunable frequency selective surface, and applying a plurality of voltages to alternating conductors disposed on the first major surface in said at least one region thereof and on the second major surface of the tunable frequency selective surface in said at least one region thereof so as to cause a plurality of varactors coupling the conductors in said at least one region thereof to be forward biased and to cause the at least one region of the tunable frequency selective surface to be in said opaque or absorptive state.

4. The method of claim 3, wherein applying the plurality of voltages comprises:

applying a first voltage to conductors disposed on the first major surface;

applying a second voltage to conductors disposed on the second major surface so as to cause the plurality of oppositely oriented in series varactors to be forward biased;

wherein the plurality of varactors oppositely oriented in series couple the conductors on the first major surface to conductors on the second major surface.

5. The method of claim 3, wherein applying the plurality of voltages comprises:

applying a first voltage to conductors disposed on the first major surface so as to cause a plurality of first oppositely oriented in series varactors coupling the conductors on the first major surface to be forward biased;

applying a second voltage to conductors disposed on the second major surface so as to cause a plurality of second oppositely oriented in series varactors coupling the conductors on the second major surface to be forward biased;

wherein the conductors on the first major surface are coupled to the plurality of second oppositely oriented in series varactors and the conductors on the second major surface are coupled to the plurality of first oppositely oriented in series varactors.

6. The method of claim 3, wherein electromagnetic energy of a desired frequency propagates through the at least a region of the tunable frequency selective surface that is tuned to the desired frequency of said electromagnetic energy.

7. The method of claim 6, wherein applying the plurality of voltages to the conductors causes only a portion of the tunable frequency selective surface to be in said absorbative state.

8. The method of claim 3, wherein a portion of the conductors are elongated and generally parallel to each other and are disposed along a length of the first major surface.

9. The method of claim 8, wherein another portion of the conductors are elongated and generally parallel to each other and are disposed along a width of the second major surface.

10. The method of claim 9, wherein the elongated conductors disposed on the first major surface overlap the elongated conductors on the second major surface and the elongated conductors on the second major surface overlap the elongated conductors on the first major surface.

11. The method of claim 3, wherein applying the plurality of voltages comprises:

applying a first voltage to conductors disposed on the first major surface;

applying a second voltage to conductors disposed on the second major surface so as to cause the plurality of oppositely oriented in series varactors to be forward biased;

wherein the plurality of varactors include a plurality of oppositely oriented in series varactors connecting the conductors on the first major surface and a plurality of oppositely oriented in series varactors connecting the conductors on the second major surface.

12. The method of claim 3, wherein applying the plurality of voltages causes the at least a region of the tunable frequency selective surface to be in a transmissive state.

* * * * *